US006888525B2

(12) United States Patent
Kasai et al.

(10) Patent No.: US 6,888,525 B2
(45) Date of Patent: May 3, 2005

(54) MULTIPLE-TONE DISPLAY SYSTEM

(75) Inventors: Naruhiko Kasai, Fujisawa (JP); Hiroyuki Mano, Chigasaki (JP); Shigeyuki Nishitani, Ebina (JP); Isao Takita, Fujisawa (JP); Kohji Takahashi, Mobara (JP)

(73) Assignee: Hitachi, Ltd., Tokyo (JP)

( * ) Notice: Subject to any disclaimer, the term of this patent is extended or adjusted under 35 U.S.C. 154(b) by 17 days.

(21) Appl. No.: 10/425,834

(22) Filed: Apr. 30, 2003

(65) Prior Publication Data

US 2003/0206148 A1 Nov. 6, 2003

Related U.S. Application Data

(60) Continuation of application No. 10/178,771, filed on Jun. 25, 2002, now Pat. No. 6,587,088, which is a continuation of application No. 09/972,924, filed on Oct. 10, 2001, now Pat. No. 6,437,765, which is a continuation of application No. 09/773,728, filed on Feb. 2, 2001, now Pat. No. 6,320,564, which is a continuation of application No. 09/459,341, filed on Dec. 13, 1999, now Pat. No. 6,191,766, which is a continuation of application No. 09/080,234, filed on May 18, 1998, now Pat. No. 6,100,864, which is a continuation of application No. 08/813,387, filed on Mar. 7, 1997, now Pat. No. 5,786,798, which is a continuation of application No. 08/486,291, filed on Jun. 7, 1995, now Pat. No. 5,610,626, which is a division of application No. 08/018,494, filed on Feb. 17, 1993, now Pat. No. 5,495,287.

(30) Foreign Application Priority Data

Feb. 26, 1992 (JP) ..... 4-39203

(51) Int. Cl.[7] ..... G09G 3/36
(52) U.S. Cl. ..... 345/89; 345/596
(58) Field of Search ..... 345/89, 589–596, 345/88, 94, 147, 100, 208, 210, 214; 382/167, 232, 2; 358/1.9, 426, 429, 516

(56) References Cited

U.S. PATENT DOCUMENTS

| | | | | |
|---|---|---|---|---|
| 5,030,947 | A | 7/1991 | Dieudonne et al. | 345/147 |
| 5,089,812 | A | 2/1992 | Fuse et al. | 345/147 |

(Continued)

FOREIGN PATENT DOCUMENTS

| | | |
|---|---|---|
| JP | 53148918 | 12/1978 |
| JP | 6371889 | 4/1988 |
| JP | 63271497 | 11/1988 |
| JP | S6431198 | 2/1989 |
| JP | 63161495 | 7/1989 |
| JP | 01209493 | 8/1989 |
| JP | 362017 | 3/1991 |
| JP | 05323901 | 12/1993 |
| JP | 06034946 | 2/1994 |

OTHER PUBLICATIONS

Society for Information Display International Symposium Digest of Technical Papers, vol. XXII, May 1991, pp. 555–557.

(Continued)

*Primary Examiner*—Amare Mengistu
(74) *Attorney, Agent, or Firm*—Antonelli, Terry, Stout & Kraus, LLP

(57) ABSTRACT

A dot matrix display system for multiple-tone displays, including a display device in which pixels are arrayed in a matrix shape, an LC (liquid-crystal) drive signal generator which converts color display data into LC display data, an 8-level data driver which selects one of 8-level voltages in accordance with the LC display data and then delivers the selected voltage, and an 8-level applied LC voltage generator by which the 8-level applied LC voltages to be applied to the pixels are produced so as to substantially make uniform color differences between the respectively adjacent tones of the multiple-tone displays. Owing to the substantially uniform color differences between the respectively adjacent tones, the multiple-tone displays which are uniformly seen by the human eye can be realized.

37 Claims, 15 Drawing Sheets

U.S. PATENT DOCUMENTS

| | | | | | |
|---|---|---|---|---|---|
| 5,189,407 | A | | 2/1993 | Mano et al. | 345/88 |
| 5,196,738 | A | | 3/1993 | Takahara et al. | 345/147 |
| 5,250,937 | A | | 10/1993 | Kikuo et al. | |
| 5,359,342 | A | | 10/1994 | Nakai et al. | 345/89 |
| 5,491,496 | A | | 2/1996 | Tomiyasu | 345/147 |
| 5,495,287 | A | * | 2/1996 | Kasai et al. | 345/89 |
| 5,610,626 | A | * | 3/1997 | Kasai et al. | 345/879 |
| 5,619,347 | A | | 4/1997 | Taniguchi et al. | |
| 5,786,798 | A | * | 7/1998 | Kasai et al. | 345/89 |
| 6,100,864 | A | * | 8/2000 | Kasai et al. | 345/89 |
| 6,128,407 | A | | 10/2000 | Inoue et al. | |
| 6,191,766 | B1 | * | 2/2001 | Kasai et al. | 345/89 |
| 6,204,933 | B1 | | 3/2001 | Yoshino et al. | |
| 6,320,564 | B1 | * | 11/2001 | Kasai et al. | 345/87 |
| 6,437,765 | B1 | * | 8/2002 | Kasai et al. | 345/89 |
| 6,587,088 | B2 | * | 7/2003 | Kasai et al. | 345/89 |

OTHER PUBLICATIONS

"Lecturing thesis C–480", T. Yamaguchi, et al, Spring National Meeting of the Institute of Electronics, Information and Communication Engineers of Japan, 1991.

* cited by examiner

MULTIPLE-TONE DISPLAY SYSTEM

This application is a continuation of Ser. No. 10/178,771, filed Jun. 25, 2002, now U.S. Pat. No. 6,587,088 which is a continuation of application Ser. No. 09/972,924 filed Oct. 10, 2001, now U.S. Pat. No. 6,437,765, which is a continuation of application Ser. No. 09/773,728 filed Feb. 2, 2001, now U.S. Pat. No. 6,320,564, which is a continuation of application Ser. No. 09/459,341 filed Dec. 13, 1999, now U.S. Pat. No. 6,191,766, which is a continuation of application Ser. No. 09/080,234 filed May 18, 1998, now U.S. Pat. No. 6,100,864, which is a continuation of application Ser. No. 08/813,387 filed Mar. 7, 1997, now U.S. Pat. No. 5,786,798, which is a continuation of application Ser. No. 08/486,291 filed Jun. 7, 1995, now U.S. Pat. No. 5,610,626, which in turn was a division of application Ser. No. 08/018,494 filed Feb. 17, 1993, now U.S. Pat. No. 5,495,287.

BACKGROUND OF THE INVENTION

1. Field of the Invention

The present invention relates to a display system of the dot matrix type, and a display method therefor. More particularly, it relates to a method of driving a display system for presenting multicolor/multiple-tone (or polytonal) displays, and a system therefor.

2. Description of the Related Art

An LC (liquid-crystal) display system in the prior art displays an image in such a way that interface signals received as external inputs are converted into drive signals for driving the LC display system, that the drive signals are delivered to LC drive means, and that the LC drive means accepts for 8-level display data among the delivered drive signals every horizontal line of a frame and then applies the accepted data to an LC panel as 8-level LC drive voltages conforming to the display data. With this mode, 8 tones or gradations are displayed by the 8-level voltages divided uniformly or equally, as stated in "Lecturing thesis C-480", the Spring National Meeting of the Institute of Electronics, Information and Communication Engineers of Japan, 1991.

FIG. 5 of the accompanying drawings illustrates the circuit arrangement of an 8-level uniform applied LC voltage generator (a generator by which the 8-level uniform voltages to be applied to the LC panel are produced) in the prior art. Numeral 27 indicates an LC driving supply voltage, which is divided into the 8-level voltages by resistors 28–36. Operational amplifiers 37–44 are respectively connected to the nodes of the adjacent resistors 28–36. Herein, the 8-level uniform voltages 22 to be applied to the LC panel (8-level voltages V1–V8) are produced by equalizing all the resistances of the resistors 29–35. The values of the voltages V1–V8 on this occasion are listed in Table 1 below. As can be understood from this table, all the voltage differences between the respectively adjacent levels are 0.7 [V].

TABLE 1

| TONE | VOLTAGE VALUE [V] |
|---|---|
| #1 | 6.50 |
| #2 | 5.80 |
| #3 | 5.10 |
| #4 | 4.40 |
| #5 | 3.70 |
| #6 | 3.00 |
| #7 | 2.30 |
| #8 | 1.60 |

FIG. 8 is a diagram showing an example of the relationship between the applied voltage to the LC panel and the display intensity or brightness of this LC panel in the prior art. The levels of the display intensity correspond respectively to the 8-level applied LC voltages V1–V8 obtained by uniformly dividing the supply voltage 27. In the illustrated graph, the display intensity levels are plotted on a logarithmic scale.

In this manner, the 8-level applied LC voltages are based on the uniform voltage division in the prior-art example. The uniform LC voltages incur the problem that the displayed tones are not always seen uniformly or in a well-balanced manner by the human eye.

SUMMARY OF THE INVENTION

An object of the present invention is to provide a method of and a system for presenting multiple-tone displays in which tones or gradations are made visible to the human eye uniformly or in a well-balanced manner in consideration of the optical characteristics of the displays.

In the present invention, the object is accomplished by contriving 8-level applied LC voltage generation means so as to make uniform or equalize the color differences between the respectively adjacent tones of a tonal display operation.

In one aspect of performance of the present invention, a multiple-tone display system wherein multiple-tone representations are presented on a display device which has a large number of pixels arrayed in a dot matrix shape comprises a data converter for receiving multiple-tone display information which contains a plurality of bits per pixel, and then sequentially converting the multiple-tone display information into display data which correspond to one horizontal line of the display device; a drive voltage generator for generating a plurality of drive voltage levels which substantially make uniform color differences between respectively adjacent ones of a plurality of tones that can be displayed by the multiple-tone display information containing the plurality of bits per pixel; a data driver connected to the drive voltage generator and data converter, for selecting one of the plurality of drive voltage levels from the drive voltage generator for every pixel on one line of the display device and then applying the selected drive voltage level to the display device in accordance with the display data delivered from the data convener; and a scan driver for selecting one of the horizontal lines of the display device which is to be successively displayed, in synchronism with the operations of the data converter and data driver.

According to the above construction of the present invention, the multiple-tone or polytonal representations which can be seen uniformly or in a well-balanced manner by the human eye can be realized by making uniform or equalizing the color differences between the respectively adjacent tones in a tonal display operation. Such a function and effect will be clarified from the following detailed description of embodiments read with reference to the accompanying drawings.

DETAILED DESCRIPTION OF THE PREFERRED EMBODIMENTS

First, an embodiment of the present invention will be described with reference to FIG. 1, FIGS. 3 and 4, FIGS. 6 and 7, FIGS. 9 thru 14, and Table 2.

Figure 1:
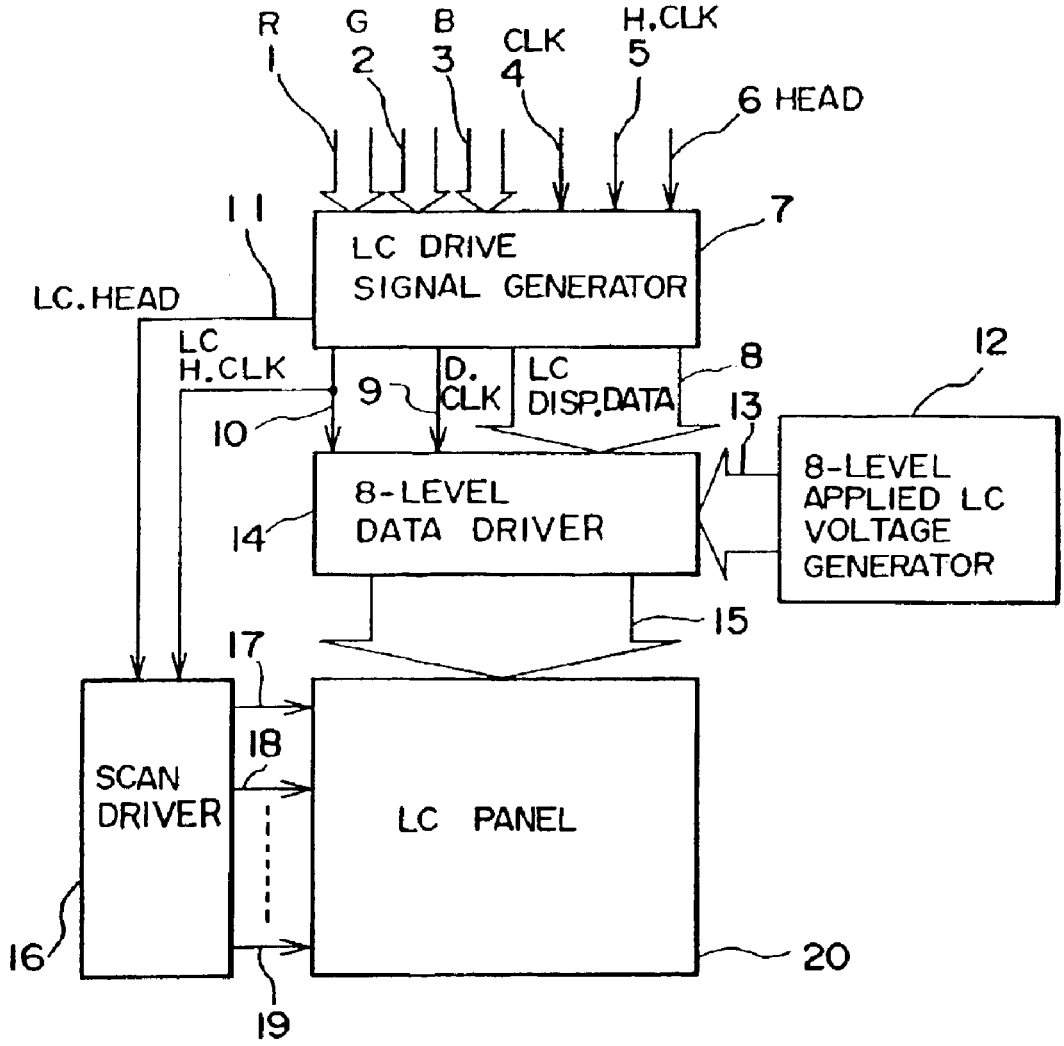
FIG. 1 is a block diagram of an embodiment of an 8-tone display system which adopts the present invention.

FIG. 1 is a block diagram of the embodiment of a multiple-tone display system to which the present invention is applied. Referring to the figure, numeral 1 indicates "red" input display data, numeral 2 "green" input display data, numeral 3 "blue" input display data, and numeral 4 a clock signal. A set of input display data 1–3 correspond to one pixel, and is fed set by set in synchronism with the clock signal 4. Each of the red input display data 1, green input display data 2 and blue input display data 3 is composed of 3 bits, and which represents any of 8 tones. Here, the word "pixel" is intended to mean one lighting element for red, green or blue, and 3 pixels constitute one dot in the case of a color display system. The details of such pixels will be explained later. Further, numeral 5 indicates a horizontal clock signal, and numeral 6 a head signal. The display data corresponding to one horizontal line are fed in one cycle of the horizontal clock signal 5 (one horizontal period). Besides, the head signal 6 indicates the head line of the display data, and the display data corresponding to one frame are fed in one cycle of the head signal 6. The multiple-tone display system in this embodiment comprises an LC (liquid-crystal) drive signal generator 7, which produces LC display data 8, a data clock signal 9, an LC horizontal clock signal 10 and an LC head signal 11. The LC drive signal generator 7 rearranges the input display data 1–3 into the order of R (red) pixels, G (green) pixels and B (blue) pixels for the purpose of presenting LC displays, whereupon it delivers the display data for 8 pixels in parallel. In this regard, each display data for one pixel is composed of 3 bits representing any of the 8 tones as stated before. Besides, the LC drive signal generator 7 receives the clock signal 4, horizontal clock signal 5 and head signal 6 so as to produce the data clock signal 9, LC horizontal clock signal 10 and LC head signal 11, respectively.

An 8-level applied LC voltage generator 12 produces 8-level voltages 13 which are to be applied to an LC panel 20. As will be explained later, the 8-level applied LC voltages 13 are obtained by dividing an LC driving supply voltage (27 in FIG. 9) nonuniformly. An 8-level data driver 14, a typical example of which is a product "HD66310" manufactured by Hitachi, Ltd., accepts the LC display data 8 for one horizontal line in accordance with the data clock signal 9. Thereafter, it shifts the accepted data to its output stage in synchronism with the LC horizontal clock signal 10. In accordance with the shifted data, one level is selected for each of the output data lines of the 8-level data driver 14 from among the 8-level applied LC voltages 13, whereby LC horizontal data 15 are output. Accordingly, the 8-level data driver 14 delivers as the output LC horizontal data 15 the LC display data 8 of a horizontal line which is one line precedent to the line accepted by the data clock pulse 9. The LC display data 8 are data which are conformed to the input specifications of the 8-level data driver 14.

The inputs of the aforementioned product "HD66310" are such that the data for one pixel is composed of 3 bits, and that 4 pixels are received in parallel. In the ensuing description of the illustrated example, the inputs of the 8-level data driver 14 shall be so assumed that the data for one pixel is composed of 3 bits and that the 8 pixels (24 bits) are received in parallel. Shown at numeral 16 is a scan driver, which delivers its output to any of the first scan line 17, the second scan line 18, . . . through the nth scan line 19. That is, the scan driver 16 produces its output voltage for selecting that one of the scan lines 17–19 which corresponds to the horizontal line for displaying the LC horizontal data 15 delivered from the 8-level data driver 14. The LC panel 20 has a resolution of m horizontal dots (3·m pixels) and vertical lines, and presents the 8-tone displays in accordance with the voltages of the LC horizontal data 15.

Figure 3:
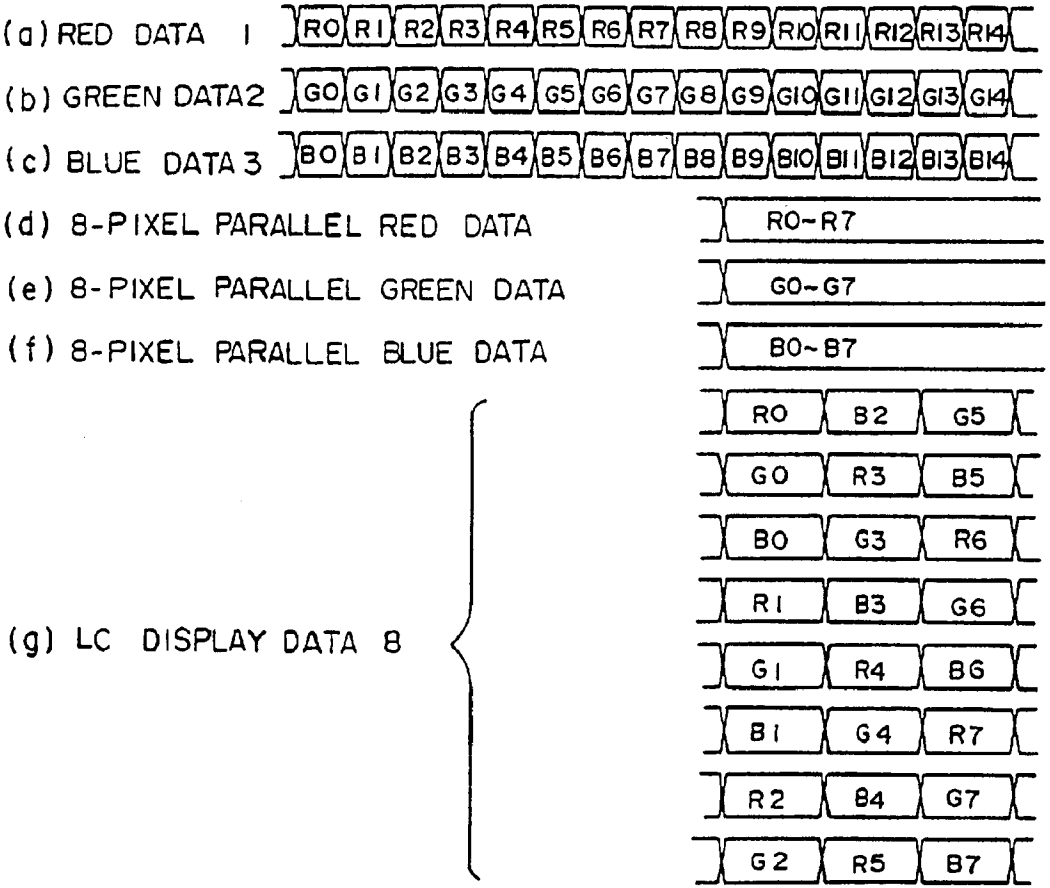
FIG. 3 is a timing chart for explaining the operation of an LC (liquid-crystal) drive signal generator depicted in FIG. 1.

FIG. 3 is a timing chart of the various signals concerning the operation in which the LC drive signal generator 7 produces the LC display data 8 from the input display data 1–3 in the embodiment of FIG. 1. Symbol (a) in FIG. 3 denotes the "red" input display data 1, symbol (b) the "green" input display data 2, and symbol (c) the "blue" input display data 3. The data 1–3 are signals which are simultaneously fed pixel by pixel, and which for one pixel is 3-bit data representative of any one of 8 tones. Symbols (d)–(f) denote those parallel signals for 8 pixels into which the input display data 1–3 fed pixel by pixel as shown at (a)–(c) have been respectively converted. Symbol (g) denotes the LC display data 8. The data 8 are those parallel data for 8 pixels into which all of the red, green and blue data have been rearranged in conformity with the pixel array of the LC panel 20.

Figure 4:
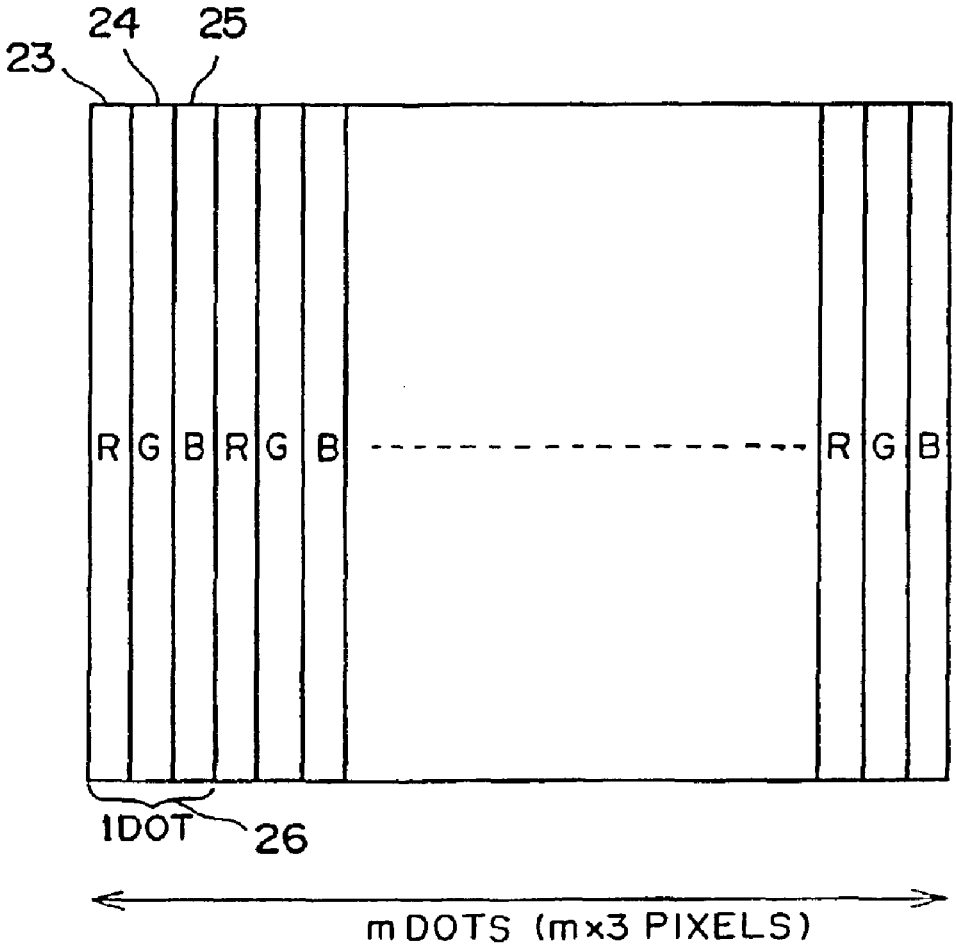
FIG. 4 is a diagram showing the pixel configuration of an LC panel depicted in FIG. 1.
Figure 5:
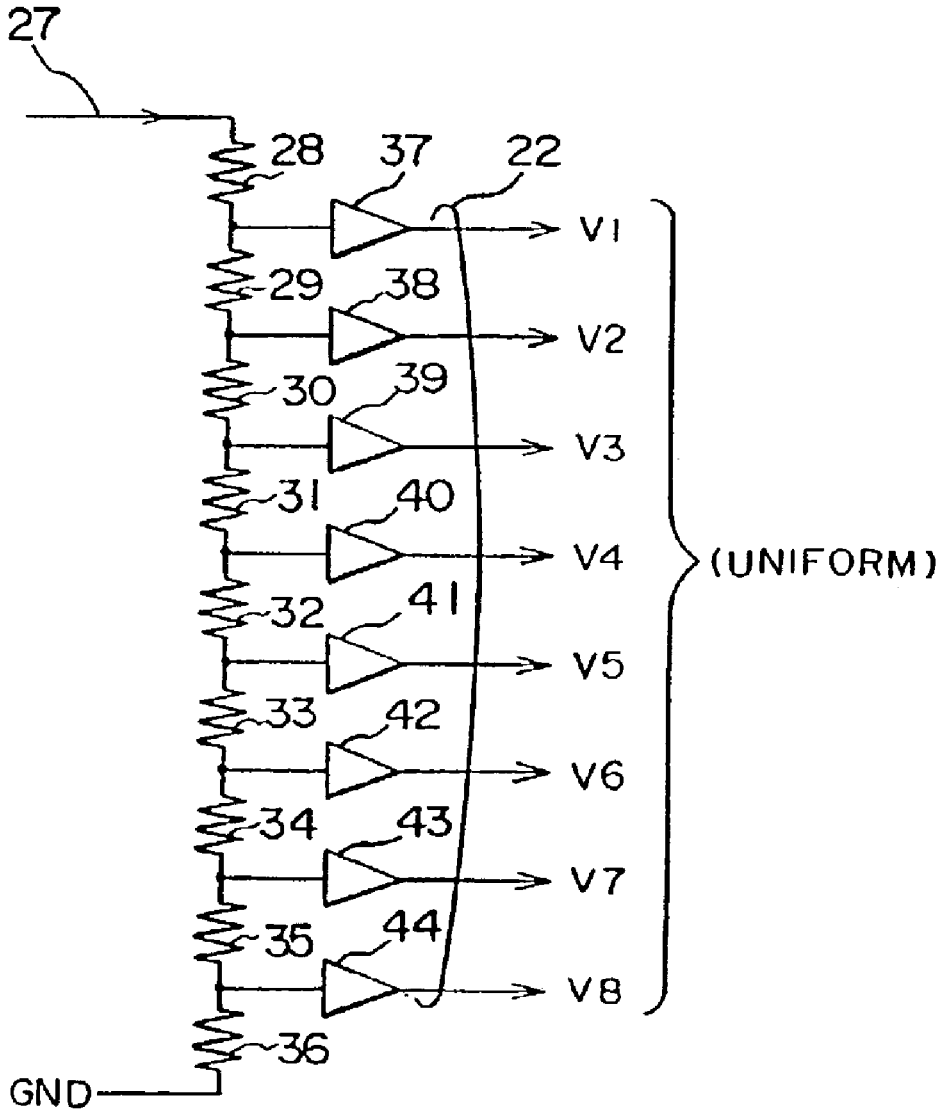
FIG. 5 PRIOR ART
FIG. 5 is a circuit diagram showing the internal arrangement of an 8-level uniform applied LC voltage generator in the prior art.

FIG. 4 illustrates the pixel configuration of the color LC panel 20. The 3 pixels of a "red" pixel 23, a "green" pixel 24 and a "blue" pixel 25 constitute one dot 26. The LC display data 8 are generated in conformity with the depicted pixel array.

Figure 9:
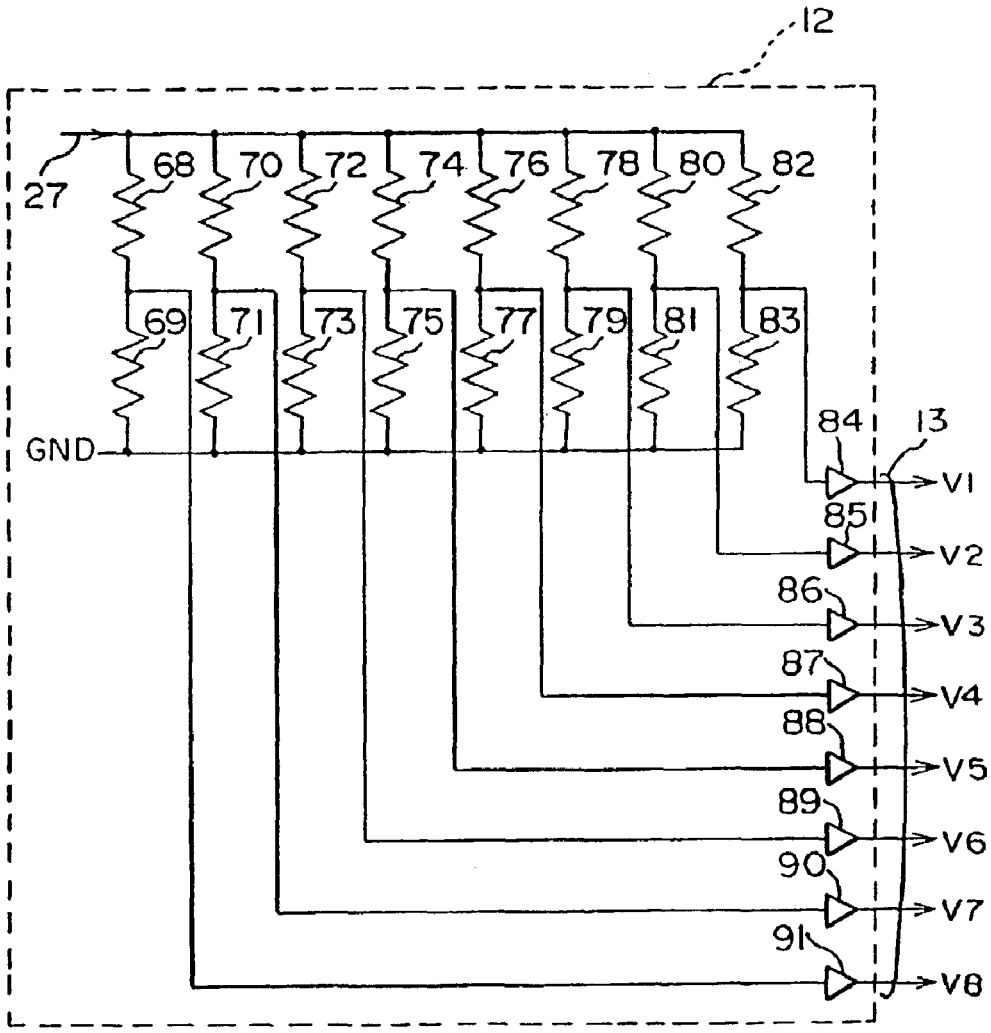
FIG. 9 is a circuit diagram showing the internal arrangement of an 8-level applied LC voltage generator depicted in FIG. 1.

FIG. 9 illustrates an example of the internal circuit arrangement of the 8-level applied LC voltage generator 12 shown in FIG. 1. Numeral 27 indicates an LC driving supply voltage. The voltage generator 12 includes resistors 68–83, and operational amplifiers 84–91. Pairs of resistors 68 and 69, 70 and 71, 72 and 73, 74 and 75, 76 and 77, 78 and 79, 80 and 81, and 82 and 83 divide the LC driving supply voltage 27 so as to deliver the 8-level applied LC voltages 13 (V8–V1) through the corresponding operational amplifiers 91–84, respectively. In this embodiment, the voltages 13 to be applied to the LC panel 20 are set at a relationship of V1>V2> . . . >V7>V8. It is also assumed that the tone or gradation #1 (black display: lowest intensity or brightness level) of each pixel is attained by the voltage V1, that the tone #8 (white display: highest intensity level) thereof is attained by the voltage V8, and that the tones #2–#7 (halftones: intermediate intensity levels) thereof are respectively attained by the other voltages V2–V7.

Figure 6:
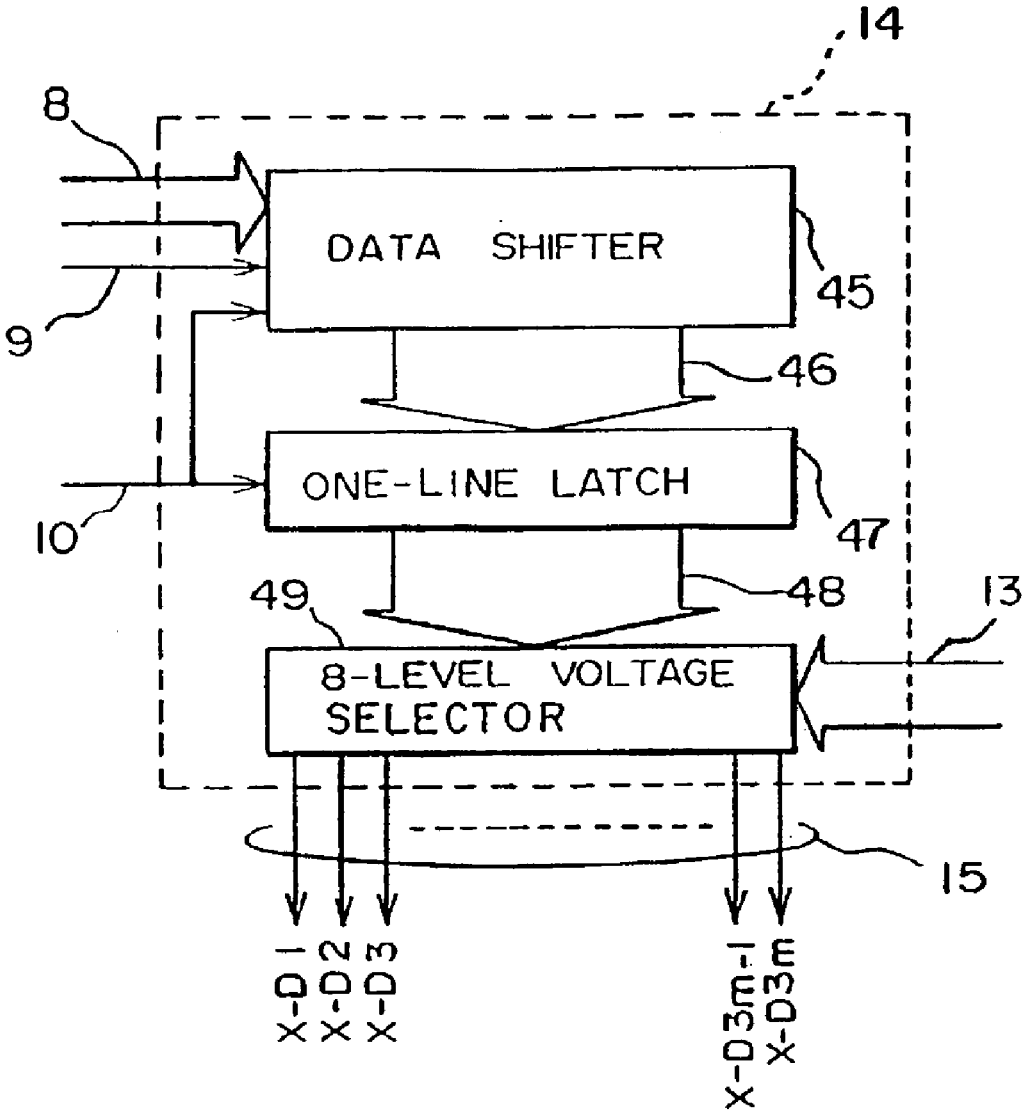
FIG. 6 is a block diagram of an 8-level data driver depicted in FIG. 1.

FIG. 6 is a block diagram showing the details of the 8-level data driver 14. Numeral 45 indicates a data shifter, and numeral 46 shifted data. The data shifter 45 accepts the LC display data 8 for one line within one horizontal period, and delivers them as the shifted data 46 in accordance with the data clock signal 9. Besides, numeral 47 indicates a one-line latch, and numeral 48 display data. The one-line latch 47 latches the shifted data 46 corresponding to one line, and delivers them as the display data 48 in synchronism with the LC horizontal clock 10. An 8-level voltage selector 49 selects one of the 8-level applied LC voltages 13 for each of the output lines thereof in accordance with the display data 48, and delivers the selected voltage levels as the LC horizontal data 15 (X-D1 to X-D3*m*) to the output lines. The symbols X-D1 to X-D3*m* signify that the horizontal lines of the LC horizontal data 15 are in the number of (3×m) because the LC panel 20 has the resolution of the m horizontal dots each of which is composed of 3 pixels.

Figure 7:
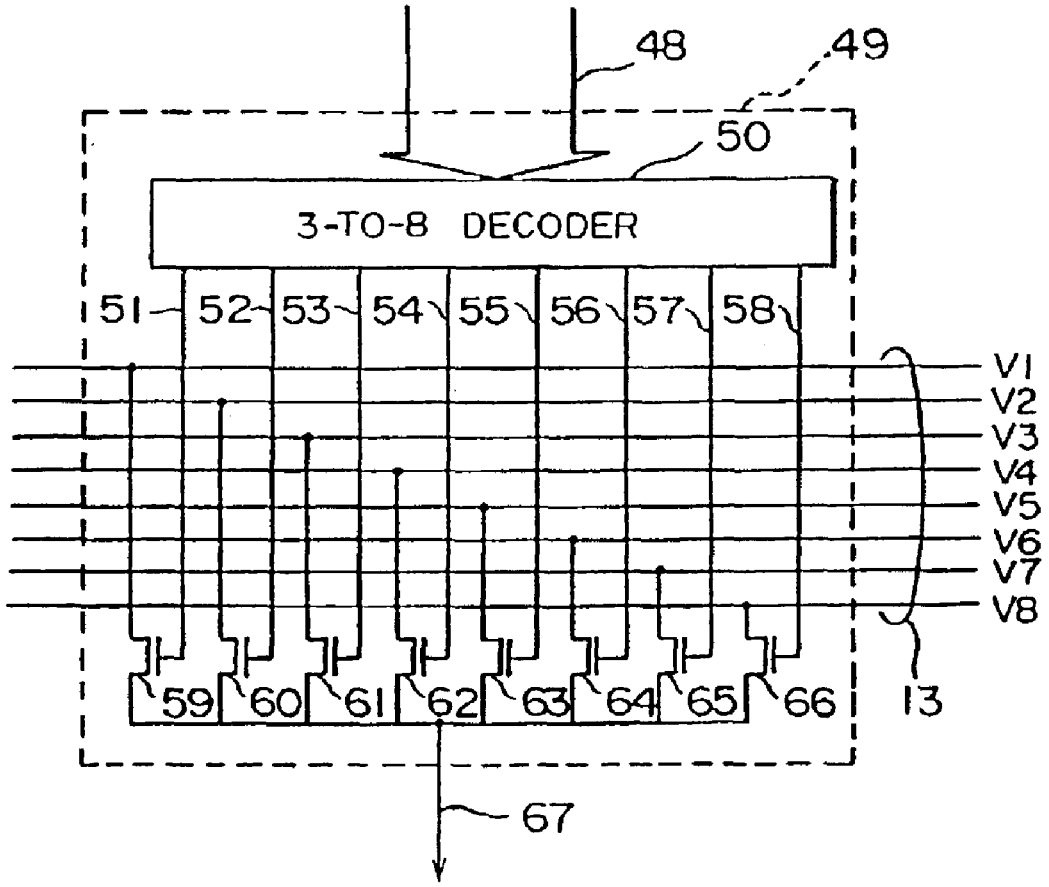
FIG. 7 is a circuit diagram showing the internal arrangement of an 8-level voltage selector depicted in FIG. 6.
Figure 8:
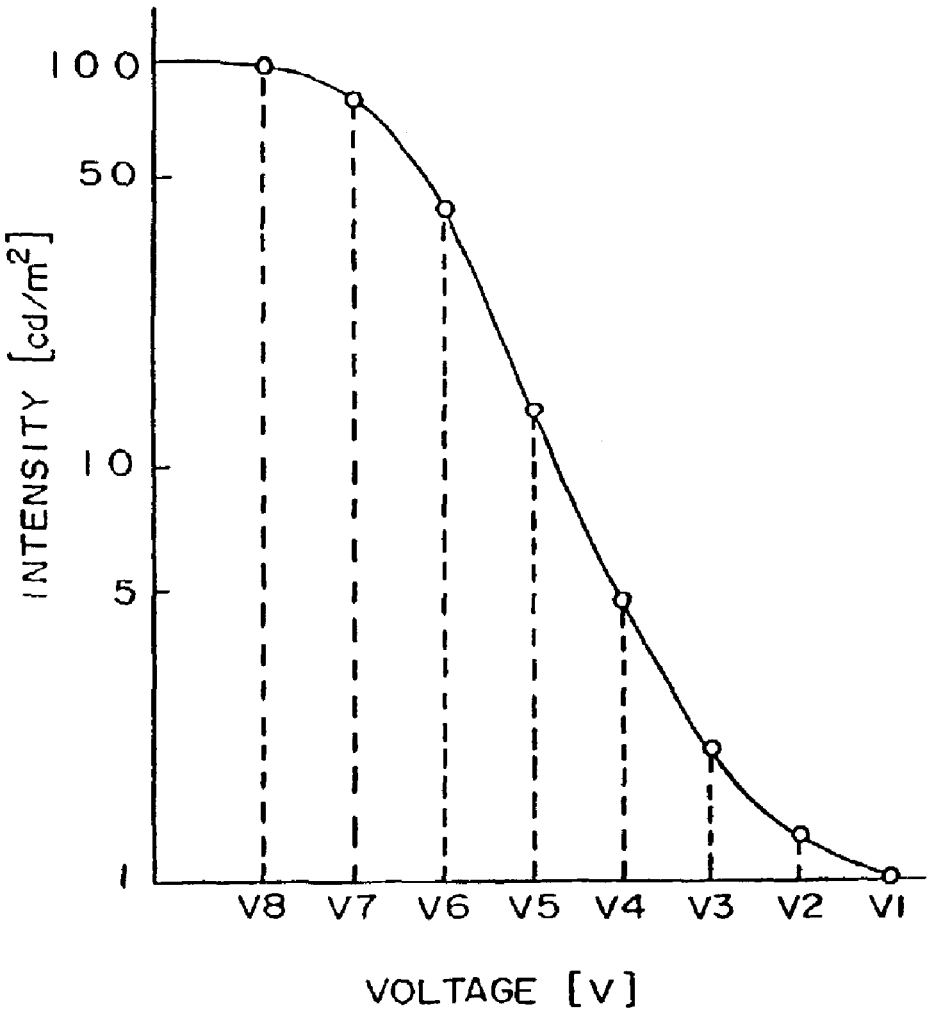
FIG. 8 PRIOR ART
FIG. 8 is a graph showing an example of the relationship between the applied voltage of an LC panel and the display intensity thereof in the prior art.

FIG. 7 is a circuit diagram showing the internal arrangement of the 8-level voltage selector 49 of the 8-level data driver 14. The voltage selector 49 includes a 3-to-8 decoder 50, decoder output lines 51–58 and switching elements 59–66. Numeral 67 indicates an LC horizontal data line, which is one of the output lines for the LC horizontal data (X-D1 to X-D3*m*). The 3-to-8 decoder 50 brings one of the decoder output lines 51–58 to "1" in accordance with the display data 48 each being composed of 3 bits per pixel, thereby turning "on" one of the switching elements 59–66. Thus, one level of the 8-level applied LC voltages 13 is selected and is delivered to the LC horizontal data line 67.

Now, the operation of this embodiment will be described.

Referring to FIG. 1, the LC drive signal generator 7 produces the LC display data 8 synchronous with the data clock signal 9 for the LC displays from the "red" input display data 1, "green" input display data 2, "blue" input display data 3 and clock signal 4. Also, it produces the data clock signal 9, LC horizontal clock signal 10 and LC head signal 11 which are LC driving signals, from the horizontal clock signal 5 and head signal 6.

The 8-level applied LC voltage generator 12 produces the applied LC voltages 13 (the voltages to be applied to the LC panel 20) of 8 levels whose voltage differences are set as desired as will be detailed later.

Figure 1A:
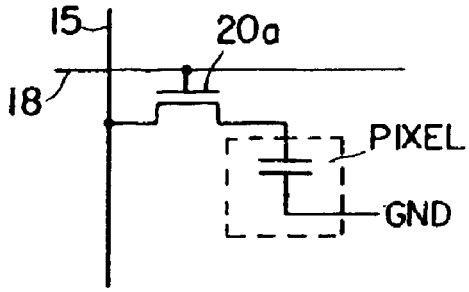
FIG. 1A depicts a type of switching element which can be utilized in a display device within a display system in accordance with the present invention.

The 8-level data driver 14 produces the LC horizontal data 15 from the LC display data 8, data clock signal 9, LC horizontal clock signal 10 and 8-level nonuniform applied LC voltages 13. The scan driver 16 accepts the level of the "1" level of the LC head signal 11 in accordance with the LC horizontal clock signal 10, and supplies the first scan line 17 with the selecting voltage (the output voltage of the scan driver 16 for selecting the horizontal line of the LC panel 20). Thereafter, the selecting voltage of the scan driver 16 is successively shifted to the second scan line 18, and on and on to the nth scan line 19 in accordance with the LC horizontal clock signal 10. Thus, one frame of the LC panel 20 is scanned. On this occasion, the voltages of the LC horizontal data lines 15 are fed from the 8-level data driver 14 to the LC panel 20, while the selecting voltage is delivered from the scan driver 16 on the scan line 17, 18, . . . 19, causing the panel switching elements, such as switching element 20*a* in FIG. 1A, to present a conforming display. Incidentally, the color display operation is effected with $8^3$ (512) colors on the basis of the combination of the 8 tones of the respective primary colors (red, green and blue).

A method of setting the 8-level applied LC voltages 13 adjusted to the visual characteristics of the human eye will be explained in detail.

Figure 10:
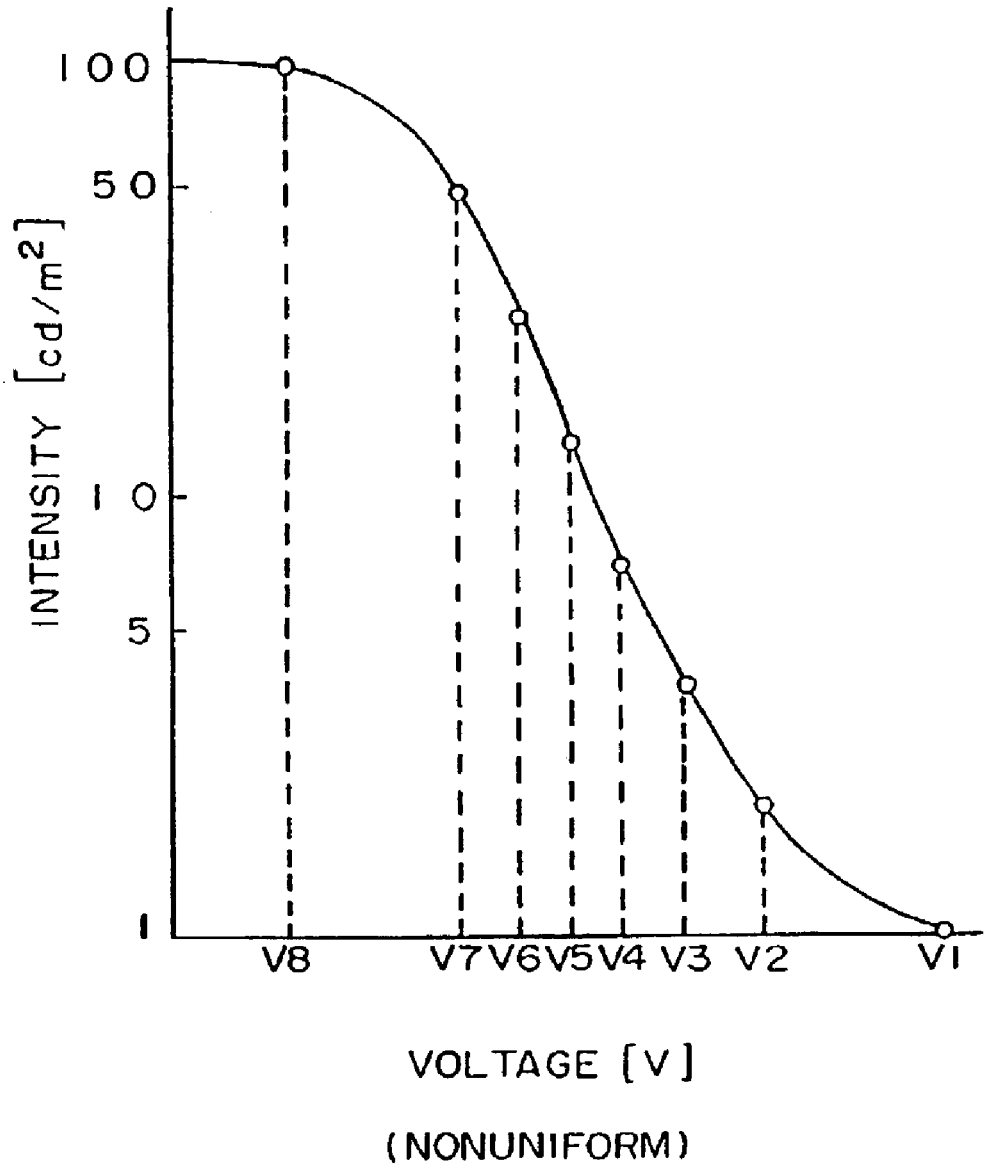
FIG. 10 is a graph showing an example of the setting of 8-level applied LC voltages.
Figure 11:
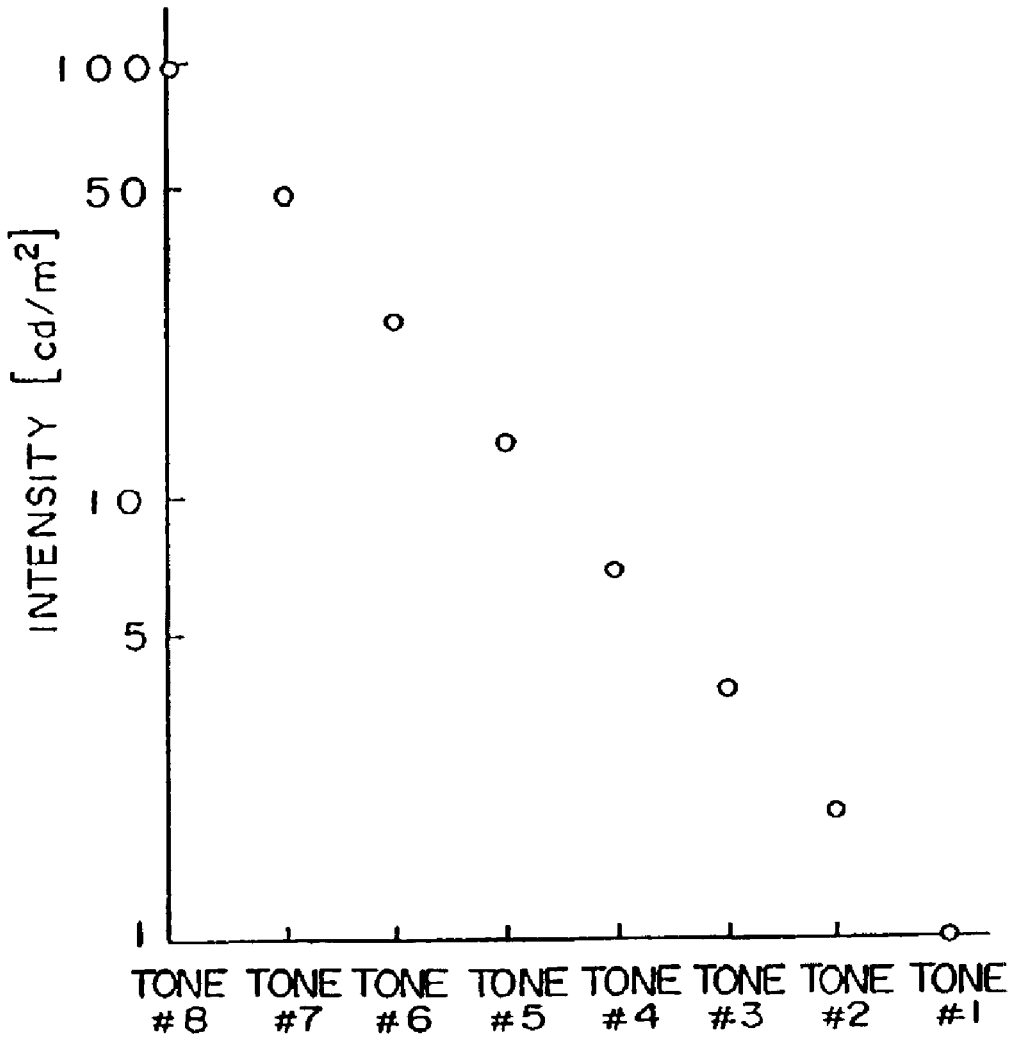
FIG. 11 is a graph showing the characteristics of 8-tone display intensity levels which are attained by the voltage setting illustrated in FIG. 10.

The display intensity or brightness in the case of setting the voltages V1–V8 nonuniformly is illustrated in FIG. 10. The display intensity characteristics of the 8 tones in this case become as shown in FIG. 11. Herein, the tones or gradations #1–#8 are set so as to make uniform the levels of the display intensity on a logarithmic scale.

Figure 12:
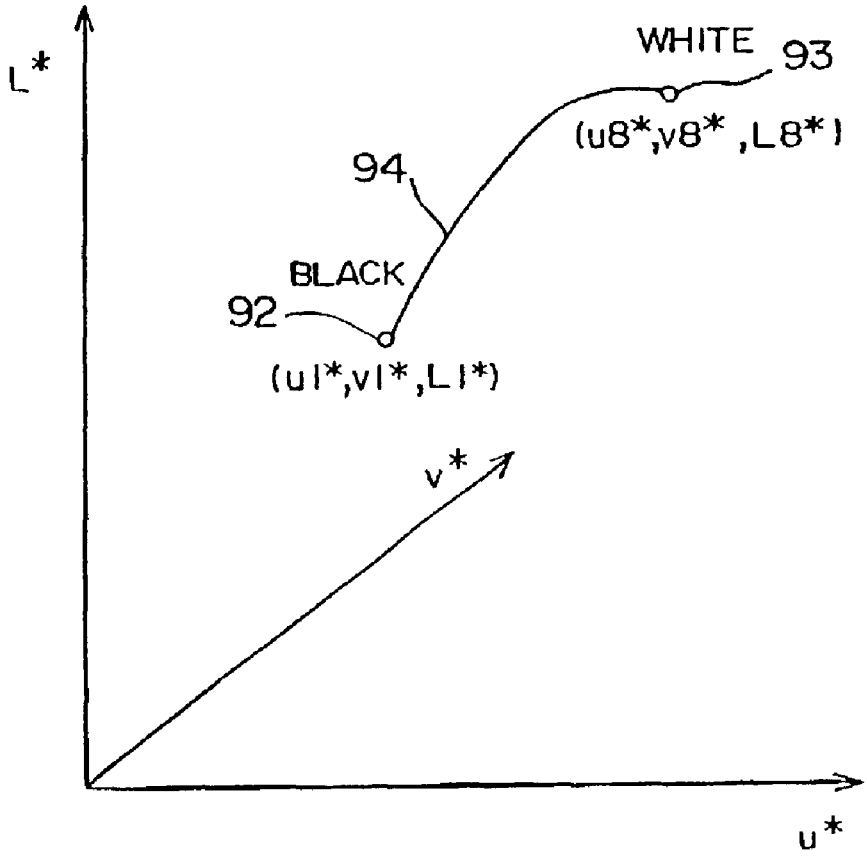
FIG. 12 is a graph showing the coordinates of a white display and a black display within the CIELUV uniform color space.

FIG. 12 illustrates the CIELUV uniform color space stipulated by the CIE (Commission International de l 'Eclairage). The distance between coordinate points within this space expresses that difference of colors which is visible to the human eye. Marks * are affixed to the coordinate values of the coordinate point 92 of the black display based on the level V1 among the 8-level applied LC voltages 13 and the coordinate point 93 of the white display based on the level V8. These marks * indicate that psychological factors are considered in addition to coordinates (Y, u', v') obtained by an optical measurement. Shown at numeral 94 is the locus of coordinates obtained by changing the 8-level applied LC voltages 13 from the level V1 to the level V8 for each of the R, G and B pixels. Incidentally, the coordinates are obtained irrespective of the properties (LC material, color filter characteristics, etc.) of the LC panel 20 by conducting the optical measurement after the voltage setting. The method of optical measurement in this embodiment will be stated below.

An optical measuring apparatus employed in this embodiment is a product "1980B" fabricated by PHOTO RESEARCH INC. The coordinate (Y) expressive of the intensity and the coordinates (u', v') expressive of the colors can be obtained by measuring light on the front surface of the LC panel 20 in SPECTRARADIOMETER MODE among the measurement modes of the apparatus "1980B". The range of the measurement is within a circle having a diameter of about 5 mm at the central part of the LC panel 20. The same voltage is applied to all of the R, G and B pixels on each occasion. The coordinates (Y, u', v') obtained by the optical measurement for any desired voltage setting are computed in accordance with Equations (1), whereby they can be reduced to the coordinates within the CIELUV uniform color space:

$$\left.\begin{aligned} L^* &= 166\left(\frac{Y}{Y0}\right)^{1/3} - 16\left(\text{where } \frac{Y}{Y0} > 0.008856\right), \\ u^* &= 13\,L^*(u' - u0'),\ \ v^* = 13\,L^*(v' - v0') \end{aligned}\right\} \tag{1}$$

The distances between the coordinates contained in the CIELUV uniform color space are called "color differences" which are the differences of the colors seen by the human eye. Incidentally, coordinate values (Y0, u0', v0') express the intensity and color coordinates of a known reference color (for example, the white of a fluorescent lamp). By way of example, the color difference (dE*) between the black display 92 based on the 8-level applied LC voltage V1 and the white display 93 based on the voltage V8 as shown in FIG. 12 is computed by Eq. (2):

$$dE^* = \sqrt{(L8^* - L1^*)^2 + (u8^* - u1^*)^2 + (v8^* - v1^*)^2} \quad (2)$$

Herein, the exemplified distance is a distance in a straight line and is different from a distance extending along the locus 94 depicted in FIG. 12. Accordingly, the distance of the locus 94 can be found in such a way that, while the applied voltage is changed little by little between the levels V1 and V8, the color differences involved between the respective voltages are computed, and the computed color differences are added up. Incidentally, the above equations (1) and (2) are respectively contained on page 143 and page 149 in "Mitsuo Ikeda: Shikisai-kōgaku no Kiso (Fundamentals of Color Engineering)" (issued by Asakura Book Store in 1980).

In this embodiment, while the applied voltage is changed little by little (for example, every 0.1 or 0.2 V between the levels V1 and V8, the color differences involved between the respective voltages are calculated, and the calculated color differences are added up, thereby finding the distances involved between the respectively adjacent applied voltages and the distance along the locus 94. According to the present invention, in order to make uniform or equalize the color differences among the 8 tones or gradations of the display operation, the distance of the locus 94 is divided by (the number of tones−1), namely, by 7 in the case of the 8-tone display operation. Subsequently, a set of applied voltages (voltages to be applied to the LC panel 20) are evaluated in order that the color differences between the respectively adjacent tones may substantially agree with a value obtained by the division.

After setting the applied voltages, the optical measurement is conducted for the individual tonal displays, and the color differences between the respectively adjacent tones are computed using Eq. (2). Herein, in a case where the computed color differences are different from the requested ones, the steps of the voltage setting, optical measurement and color difference computation are performed again. Such processing is iterated until the requested color differences are obtained. Results thus obtained are listed in Table 2 below.

TABLE 2

| Tone | Voltage value [V] | Color difference |
|---|---|---|
| #1 | 6.50 | |
| #2 | 4.96 | 15.2 |
| #3 | 4.92 | 15.4 |
| #4 | 3.83 | 15.4 |
| #5 | 3.43 | 15.4 |
| #6 | 3.00 | 15.4 |
| #7 | 2.51 | 15.3 |
| #8 | 1.77 | 15.3 |

In this table, the value of each "color difference" represents the color difference with respect to the tone of the adjoining upper row. For example, the value of the color difference of the row of the tone #3 represents the color difference with respect to the tone #2. Here, the color differences are substantially uniform and are 15.3 on average.

Figure 13:
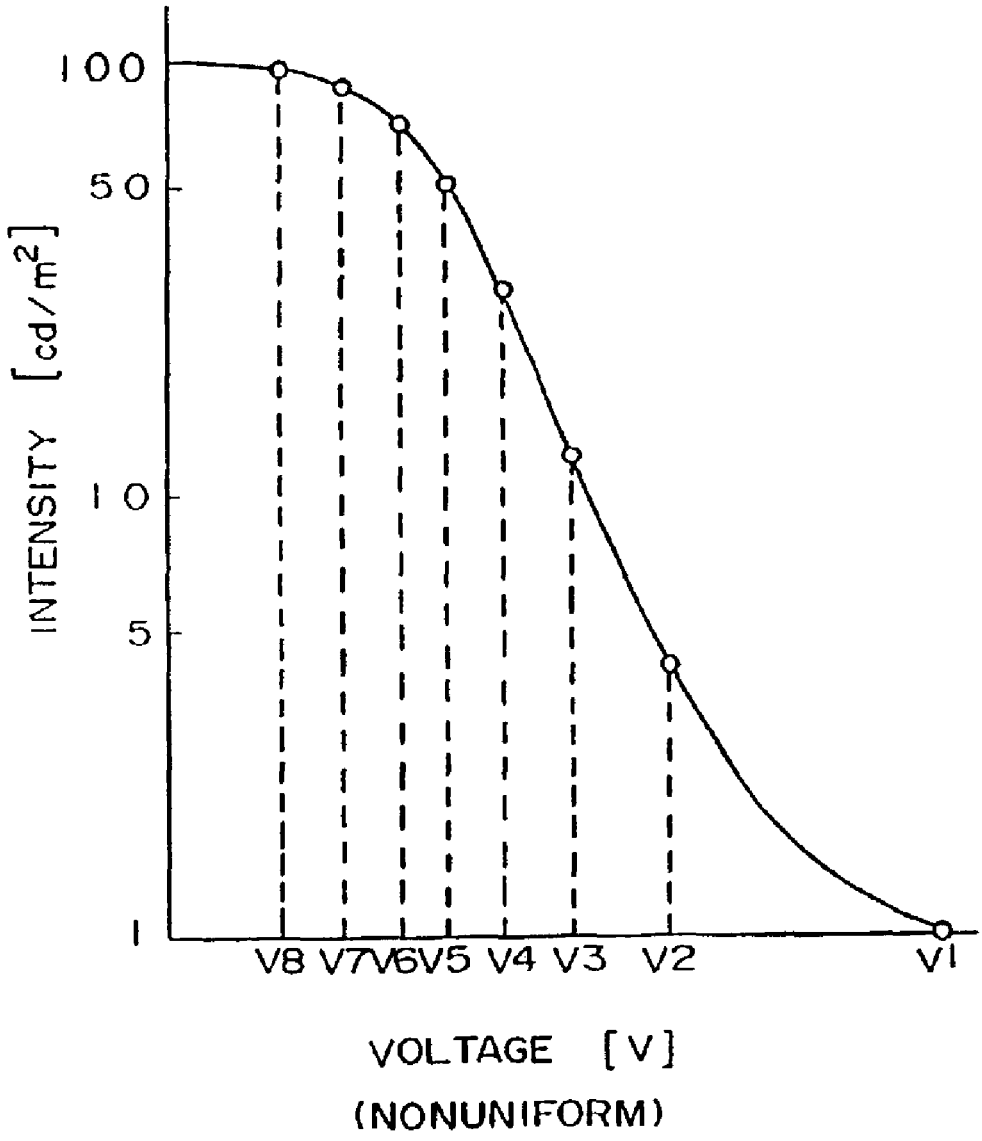
FIG. 13 is a graph showing display intensity levels in the case of setting applied voltages so as to make uniform color differences.
Figure 14:
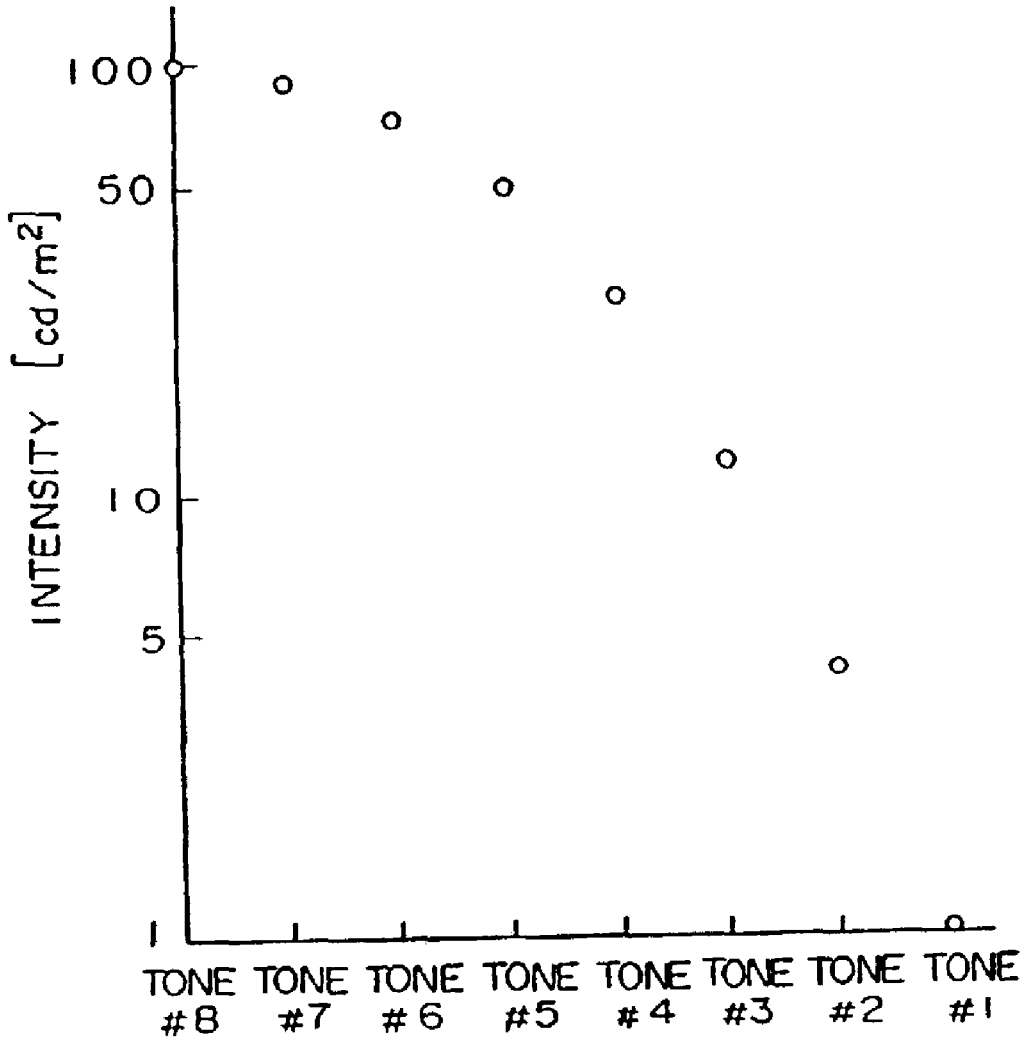
FIG. 14 is a graph showing the characteristics of the 8-tone display intensity levels which are attained by the voltage setting illustrated in FIG. 13.

The display intensity or brightness levels of the LC panel 20 attained by setting the 8-level applied LC voltages 13 as listed in Table 2 become as shown in FIG. 13, while the display intensity characteristics of the 8 tones become as shown in FIG. 14.

Meanwhile, an embodiment in the case of increasing the number of tones from 8 to 16 in accordance with an FRC (frame rate control) mode will be described with reference to FIG. 2, FIG. 15, and Tables 3 and 9.

The "FRC mode" is a method wherein the displays of two tones for a certain pixel are changed-over alternately in successive frames (each frame corresponding to one frame scan period), thereby attaining a tone intermediate between the two tones.

Figure 2:
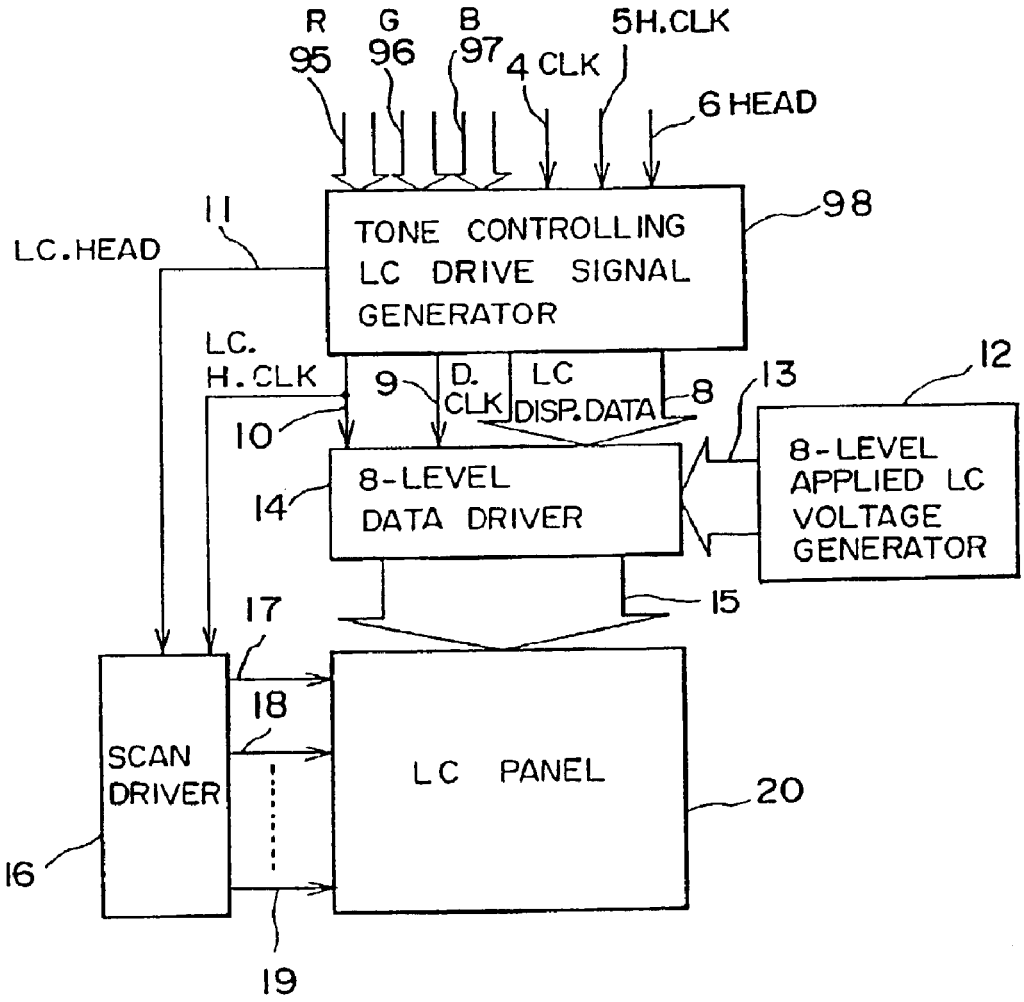
FIG. 2 is a block diagram of an embodiment of a 16-tone display system which adopts the present invention.

FIG. 2 is a block diagram of the embodiment of an LC (liquid-crystal) multiple-tone display system which employs the FRC mode. Referring to the figure, numeral 95 indicates "red" input display data, numeral 96 "green" input display data, numeral 97 "blue" input display data, and numeral 4 a clock signal. In this embodiment, each of the input display data 95–97 is assumed to be 4-bit data which is fed in synchronism with the clock signal 4. Shown at numeral 98 is a tone controlling LC drive signal generator, which delivers LC display data 8, a data clock signal 9, an LC horizontal clock signal 10 and an LC head signal 11. More specifically, the tone controlling LC drive signal generator 98 converts the input display data 95–97 each being composed of 4 bits, into the LC display data 8 composed of 3 bits. Also, it produces the data clock signal 9, LC horizontal clock signal 10 and LC head signal 11 in the same manner as in the foregoing embodiment. An 8-level applied LC voltage generator 12 produces 8-level applied LC voltages (voltages to be applied to an LC panel 20) 13 for the FRC mode. A method of converting the 4-bit input display data 95–97 into the 3-bit LC display data 8, and a method of setting the 8-level applied LC voltages 13 will be detailed later. An 8-level data driver 14, a scan driver 16 and the LC panel 20 are similar to the corresponding devices in the case of the 8-tone display operation, respectively.

Figure 15:
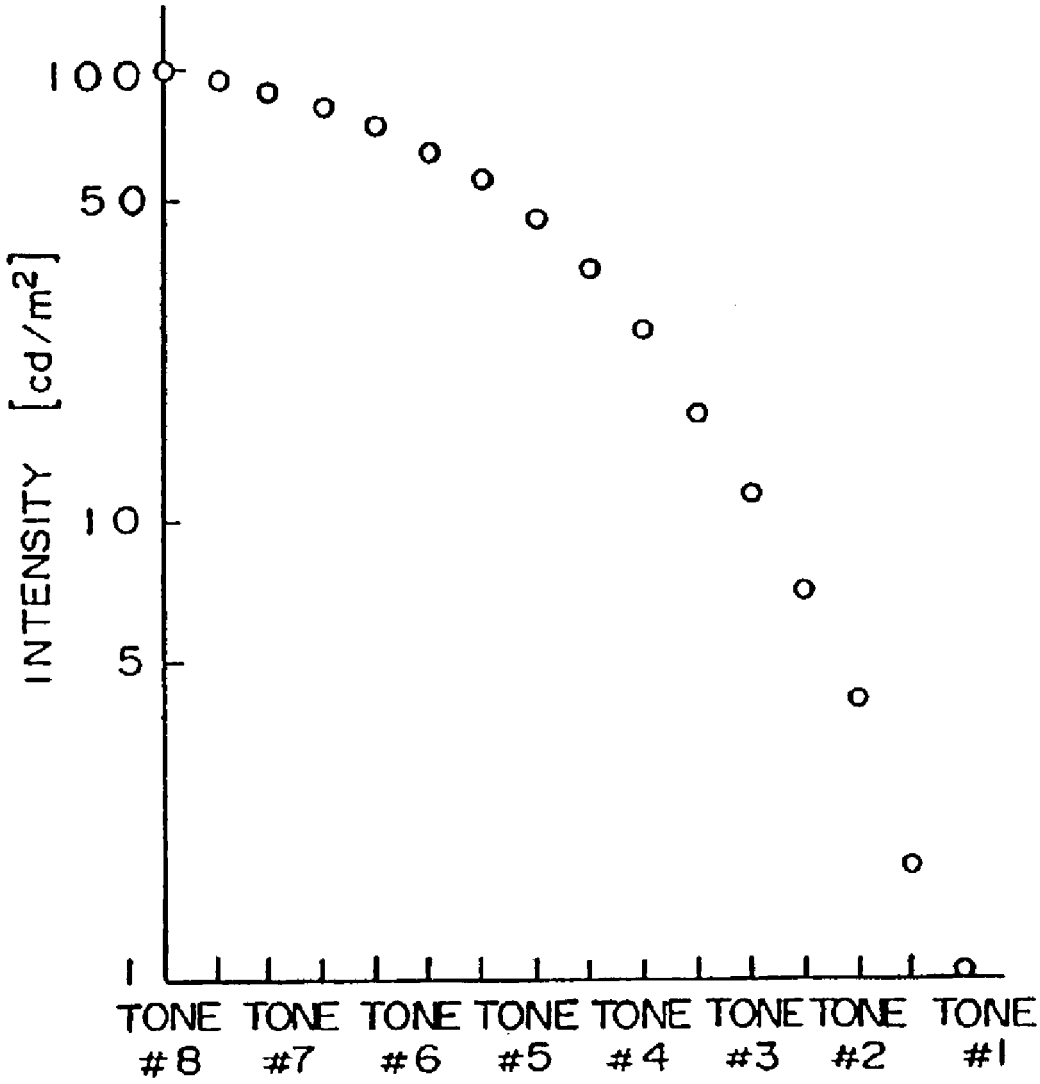
FIG. 15 is a graph showing the display intensity characteristics of a 16-tone display operation according to the present invention.

FIG. 15 is a graph showing the display intensity or brightness characteristics of 16-tone displays which are presented in each of colors R (red), G (green) and B (blue) by this embodiment.

In order to explain the details of the operation of this embodiment, FIGS. 2 and 15 will be referred to again.

In the construction of FIG. 2, the LC drive signal generator 98 produces the LC display data 8 of 3 bits synchronous with the data clock 9 for the LC display operation, on the basis of the "red" input display data 95, "green" input display data 96 and "blue" input display data 97 which are respectively fed in serial 4-bit units and in synchronism with the clock signal 4. An example of the conversion of the 4-bit data into the 3-bit data is indicated in Table 3 below.

That is, Table 3 exemplifies the data of 16-tone displays and the values of attained color differences in this embodiment.

TABLE 3

| Tone | 4-bit data | 3-bit data | Voltage value [V] | Color diff. |
|---|---|---|---|---|
| #1 | 0000 | 000 | 6.50 | |
| #2 | 0001 | 000 - 001 | 6.50 - 4.57 | 4.695 |
| #3 | 0010 | 001 | 4.57 | 5.751 |
| #4 | 0011 | 001 - 010 | 4.57 - 4.02 | 6.242 |
| #5 | 0100 | 010 | 4.02 | 6.943 |

TABLE 3-continued

| Tone | 4-bit data | 3-bit data | Voltage value [V] | Color diff. |
|---|---|---|---|---|
| #6 | 0101 | 010 - 011 | 4.02 - 3.72 | 6.212 |
| #7 | 0110 | 011 | 3.72 | 6.714 |
| #8 | 0111 | 011 - 100 | 3.72 - 3.37 | 7.240 |
| #9 | 1000 | 100 | 3.37 | 7.435 |
| #10 | 1001 | 100 - 101 | 3.37 - 3.12 | 8.192 |
| #11 | 1010 | 101 | 3.12 | 8.059 |
| #12 | 1011 | 101 - 110 | 3.12 - 2.77 | 7.573 |
| #13 | 1100 | 110 | 2.77 | 7.585 |
| #14 | 1101 | 101 - 111 | 3.12 - 1.77 | 5.689 |
| #15 | 1110 | 110 - 111 | 2.77 - 1.77 | 7.072 |
| #16 | 1111 | 111 | 1.77 | 10.707 |

Each of the tones which indicates two sorts of 3-bit data, is subjected to the FRC mode. The tone controlling LC display data generator 98 changes-over the two sorts of data alternately in the successive frames.

Besides, the LC drive signal generator 98 produces the data clock signal 9, LC horizontal clock signal 10 and LC head signal 11 which are LC driving signals, from a horizontal clock signal 5 and a head signal 6 in the same manner as in the foregoing case of the 8-tone display operation.

The 8-level applied LC voltage generator 12 produces the 8-level applied LC voltages 13 (voltages to be applied to the LC panel 20) the differences of which are set as desired. The voltages are set so that the LC panel 20 may exhibit intensity or brightness characteristics similar to those in the case of the 8-tone display operation. The values of the voltages and the color differences between the respectively adjacent tones or gradations on that occasion are listed in Table 3. As seen from the table, the color differences have errors of ±50% or so with respect to their average value of 7.1, but the errors pose no problem in vision. The 16-tone display intensity characteristics shown in FIG. 15 are similar to the 8-tone display intensity characteristics shown in FIG. 14. Incidentally, the large errors of the color differences in this embodiment are ascribable to the fact that, with the FRC operation, when the voltage value of any tone not based on the FRD (for example, the tone #3) is changed, also the voltage values of the FRC-based tones adjoining the tone (the tones #2 and #4) change, so the color differences are difficult to make uniform.

The 8-level data driver 14 produces LC horizontal data 15 from the LC display data 8, data clock signal 9, LC horizontal data 10 and 8-level nonuniform applied LC voltages 13 in the same manner as in the foregoing embodiment shown in FIG. 1. The scan driver 16 accepts the "1" level of the LC head signal 11 in accordance with the LC horizontal clock signal 10, and supplies the first scan line 17 with a selecting voltage. Thereafter, the selecting voltage of the scan driver 16 is successively shifted to the second scan line 18, and on and on to the nth scan line 19 in accordance with the LC horizontal clock signal 10. Thus, one frame of the LC panel 20 is scanned. On this occasion, the voltages on the LC horizontal data lines 15 are fed from the 8-level data driver 14 to the LC panel 20, while the selecting voltage is delivered for the scan driver 16 on the scan lines 17, 18, . . . 19, causing the panel switching elements, such as switching element 20*a* in FIG. 1A, to present a conforming display.

Moreover, 16 tones or gradations which are seen uniformly or in a well-balanced manner in each of the colors of "red", "green" and "blue" by the human eye can be attained by modifying the embodiment of FIG. 2 as follows: Three 8-level applied LC voltage generators 12 are disposed for the colors of, respectively, red, green and blue independently of one another. Also, the tone controlling LC drive signal generator 98 converts the 4-bit data into the 3-bit data for the colors of red, green and blue independently of one another.

Table 4 indicates another example of the combination between a voltage selling and the FRC mode for presenting 16-tone displays which have the intensity or brightness characteristics as shown in FIG. 15. Even when the combination is changed, the 16-tone displays uniformly visible to the human eye can be obtained by conforming the intensity characteristics to those shown in FIG. 15.

TABLE 4

| Tone | Voltage value [V] |
|---|---|
| #1 | 7.00 |
| #2 | 7.00 - 4.60 |
| #3 | 7.00 - 4.00 |
| #4 | 4.60 |
| #5 | 4.60 - 4.00 |
| #6 | 4.00 |
| #7 | 4.00 - 3.62 |
| #8 | 3.62 |
| #9 | 3.62 - 3.21 |
| #10 | 3.21 |
| #11 | 2.99 |
| #12 | 2.99 - 2.59 |
| #13 | 2.59 |
| #14 | 3.21 - 0.01 |
| #15 | 2.99 - 0.01 |
| #16 | 0.01 |

Even in a case where the number of tones or gradations has been further increased, tonal displays seen to be uniform by the human eye can be presented by conforming intensity or brightness characteristics to a curve as shown in FIG. 15.

According to the present invention, the color differences between the respectively adjacent tones of a tonal display operation are made uniform, whereby multiple-tone displays uniformly visible to the human eye can be obtained.

What is claimed is:

1. A display device for providing multiple-tone representations, the display device comprising:

a data driver for receiving display data and providing a drive voltage of a level corresponding to the display data;

a scan driver for providing a selecting voltage; and a display panel having a plurality of pixels arranged in a matrix, the display panel coupled to the data driver and to the scan driver to provide the drive voltage from the data driver to a pixel of the display panel selected in accordance with the selecting voltage, wherein selected pixel of the display panel displays a tone corresponding to the drive voltage, wherein the number of tones is equal to or more than eight, and wherein the intensities or brightnesses of all the intermediate tones between the first tone corresponding to the maximum drive voltage and the third tone one higher than the second tone corresponding to the minimum drive voltage are at least as great as the intensities or brightnesses on a straight line linking the intensity or brightness of the first tone and the intensity or brightness of the third tone, when the intensities or brightnesses as a function of the tones are plotted on a graph having the tones along the graph abscissa and the intensity or brightness on a logarithmic scale along the graph ordinate.

2. A display device as claimed in claim 1, further comprising:

a drive signal generator for producing a data clock signal for driving the data driver and a horizontal clock signal for driving the scan driver.

3. A display device as claimed in claim 1, further comprising:

data driver lines coupling the data driver and the pixel of the display panel; and scan driver lines coupling the scan driver and the pixel of the display panel.

4. A display device as claimed in claim 1, wherein a line linking the intensities or brightnesses of the intermediate tones has a convex shape with respect to the straight line.

5. A display device as claimed in claim 1, wherein the display data is N-bit digital display data representing $2^N$ tones.

6. A display device as claimed in claim 1, wherein the plurality of pixels include red (R) pixels, green (G) pixels and blue (B) pixels.

7. A display device as claimed in claim 6, wherein the display data is N-bit digital display data representing $2^N$ tones.

8. A display device as claimed in claim 7, wherein the drive voltage for each of the R, G, and B pixels is the same when the N-bit digital display data representing the R, G, and B pixels are the same.

9. A display device as claimed in claim 1, further comprising:

a drive voltage generator for generating drive voltage levels corresponding to tones which the display data can represent, wherein the data driver selects one of the generated drive voltage levels in accordance with the display data and provides the selected drive voltage level.

10. A display device as claimed in claim 1, wherein the pixels display black for the first tone and white for the second tone.

11. A display device as claimed in claim 1, wherein the display panel is a crystal panel.

12. A display device for providing multiple-tone representations, the display device comprising:

a data driver for receiving display data, and providing a drive voltage of a level corresponding to the display data;

a scan driver for providing a selecting voltage; and a display panel having a plurality of pixels arranged in a matrix, the display panel coupled to the data driver and to the scan driver to provide the drive voltage from the data driver to a pixel of the display panel selected in accordance with the selecting voltage, wherein the selected pixel of the display panel displays a tone corresponding to the drive voltage, wherein the number of tones is equal to or more than eight, and wherein intensities or brightnesses of all the intermediate tones between the maximum intensity or brightness and the intensity or brightness one higher than the minimum intensity or brightness which the display panel is capable of showing are greater than the intensities or brightnesses on a straight line linking the maximum intensity or brightness and the intensity or brightness one higher than the minimum intensity or brightness, when the intensities or brightnesses as a function of the tones are plotted on a graph having the tones along the graph abscissa and the intensities or brightnesses on a logarithmic scale along the graph ordinate.

13. A display device for providing multiple-tone representations, the display device comprising:

a data driver for receiving display data and providing drive voltages of a level corresponding to the display data;

a scan driver for providing a selecting voltage; and a display panel having a plurality of pixels arranged in a matrix, the display panel coupled to the data driver and to the scan driver to provide the drive voltages to a line of pixels of the display panel selected in accordance with the selecting voltage, wherein the selected line of pixels of the display panel displays tones corresponding to the drive voltages, wherein the number of tones is equal to or more than eight, and wherein intensities or brightnesses of all the intermediate tones between the first tone corresponding to the maximum drive voltage and the third tone one higher than the second tone corresponding to the minimum drive voltage form a line above a straight line linking the intensity or brightness of the first tone and the intensity or brightness of the third tone on a graph having the tones along the graph abscissa and the intensities or brightnesses on a logarithmic scale along the graph ordinate.

14. A display device for providing multiple-tone representations, the display device comprising:

a data driver for receiving display data, and providing a drive voltage of a level corresponding to the display data;

a scan driver for providing a selecting voltage; and a display panel having a plurality of pixels arranged in a matrix, the display panel coupled to the data driver and to the scan driver to provide the drive voltage to a pixel of the display panel selected in accordance with the selecting voltage, wherein the selected pixel of the display panel displays a tone corresponding to the drive voltage, wherein the number of tones is equal to more than eight, and wherein all the intensities or brightnesses between the maximum intensity or brightness and the intensity or brightness one higher than the minimum intensity or brightness which the display panel is capable of showing are greater than the intensities or brightnesses on a straight line linking the maximum intensity or brightness and the intensity or brightness one higher than the minimum intensity or brightness, when the intensities or brightnesses as a function of the tones are plotted on a graph having the tones along the graph abscissa and the intensities or brightnesses on a logarithmic scale along the graph ordinate.

15. A display device for providing multiple-tone representations, the display device comprising:

a data driver for receiving display data and providing a drive voltage of a level corresponding to the display data;

a scan driver for providing a selecting voltage; and a display panel having a plurality of pixels arranged in a matrix, the display panel coupled to the data driver and to the scan driver to provide the drive voltage from the data driver to a pixel of the display panel selected in accordance with the selecting voltage, wherein the selected pixel of the display panel displays a tone corresponding to the drive voltage, wherein the number of tones is equal to or more than eight, and wherein the intensities or brightnesses of all the intermediate tones between the third tone one lower than the first tone corresponding to the maximum drive voltage and the second tone corresponding to the minimum drive voltage are at least as great as the intensities or brightnesses on a straight line linking the intensity or brightness of the third tone and the intensity or brightness of the second tone, when the intensities or brightness as a function of the tones are plotted on a graph having the tones along the graph abscissa and the intensity or brightness on a logarithmic scale along the graph ordinate.

16. A display device as claimed in claim 15, further comprising:

a drive signal generator for producing a data clock signal for driving the data driver and a horizontal clock signal for driving the scan driver.

17. A display device as claimed in claim 16, wherein said difference of intermediate tones is equal to or less than said difference of high tones and said difference of low tones.

18. A display device as claimed in claim 15, further comprising:

data driver lines coupling the data driver and the pixel of the display panel; and scan driver lines coupling the scan driver and the pixel of the display panel.

19. A display device as claimed in claim 15, wherein a line linking intensities or brightnesses of the intermediate tones has a convex shape with respect to the straight line.

20. A display device as claimed in claim 15, wherein the display data is N-bit digital display data representing $2^N$ tones.

21. A display device as claimed in claim 15, wherein the plurality of pixels include red (R) pixels, green (G) pixels and blue (B) pixels.

22. A display device as claimed in claim 21, wherein the display data is N-bit digital display data representing $2^N$ tones.

23. A display device as claimed in claim 22, wherein the drive voltage for each of the R, G, and B pixels is the same when the N-bit digital display data representing the R, G, and B pixels are the same.

24. A display device as claimed in claim 15, further comprising:

a driver voltage generator for generating drive voltage levels corresponding to tones which the display data can represent, wherein the data driver selects one of the generated drive voltage levels in accordance with the display data and provides the selected drive voltage level.

25. A display device as claimed in claim 15, wherein the pixels display black for the first tone and white for the second tone.

26. A display device as claimed in claim 15, wherein the display panel is a liquid crystal panel.

27. A display device for providing a multiple-tone representations, the display device comprising:

a data driver for receiving display data, and providing a drive voltage of a level corresponding to the display data;

a scan driver for providing a selecting voltage; and a display panel having a plurality of pixels arranged in a matrix, the display panel coupled to the data driver and to the scan driver to provide the drive voltage from the data driver to a pixel of the display panel selected in accordance with the selecting voltage, wherein the selected pixel of the display panel displays a tone corresponding to the drive voltage, wherein the number of tones is equal to or more than eight, and wherein the intensities or brightnesses of all the intermediate tones between the intensity or brighteness one lower than the maximum intensity or brightness and the minimum intensity or brightness which the display panel is capable of showing are greater than the intensities or brightnesses on a straight line linking the intensity or brightness one lower than the maximum intensity or brightness and the minimum intensity or brightness, when the intensities or brightnesses as a function of the tones are plotted on a graph having the tones along the graph abscissa and the intensities or brightnesses on a logarithmic scale along the graph ordinate.

28. A display device for providing multiple-tone representations, the display device comprising:

a data driver for receiving display data and providing drive voltages of a level corresponding with the display data;

a scan driver for providing a selecting voltage; and a display panel having a plurality of pixels arranged in a matrix, the display panel coupled to the data driver and to the scan driver to provide the drive voltages to a line of pixels of the display panel selected in accordance with the selecting voltage, wherein the selected line of pixels of the display panel displays tones corresponding to the drive voltages, wherein the number of tones is equal to or more than eight, and wherein the intensities or brightnesses of all the intermediate tones between the third tone one lower than the first tone corresponding to the maximum drive voltage and the second tone corresponding to the minimum drive voltage form a line above a straight line linking the intensity or brightness of the third tone and the intensity or brightness of the second tone on a graph having the tones along the graph abscissa and the intensities or brightnesses on a logarithmic scale along the graph ordinate.

29. A display device for providing multiple-tone representations, the display device comprising:

a data driver for receiving display data, and providing a drive voltage of a level corresponding to the display data;

a scan driver for providing a selecting voltage; and a data driver for receiving display data and providing drive voltages of a level corresponding with the display data;

a scan driver for providing a selecting voltage; and a display panel having a plurality of pixels arranged in a matrix, the display panel coupled to the data driver and to the scan driver to provide the drive voltages to a line of pixels of the display panel selected in accordance with the selecting voltage, wherein the selected line of pixels of the display panel displays tones corresponding to the drive voltages, wherein the number of tones is equal to or more than eight, and wherein the intensities or brightnesses of all the intermediate tones between the third tone one lower than the first tone corresponding to the maximum drive voltage and the second tone corresponding to the minimum drive voltage form a line above a straight line linking the intensity or brightness of the third tone and the intensity or brightness of the second tone on a graph having the tones along the graph abscissa and the intensities or brightnesses on a logarithmic scale along the graph ordinate.

30. A display device for providing multiple-tone representations, the display device comprising:

a data driver for receiving display data, and providing a drive voltage of a level corresponding to the display data;

a scan driver for providing a selecting voltage; and a display panel having a plurality of pixels arranged in a matrix, the display panel coupled to the data driver and to the scan driver to provide the drive voltage to a pixel of the display panel selected in accordance with the selecting voltage, wherein the selected pixel of the display panel displays a tone corresponding to the drive voltage, wherein the number of tones is equal to or more than eight, and wherein all the intensities or brightnesses between the intensity or brightness one lower than the maximum intensity or brightness and the minimum intensity or brightness which the display panel is capable of showing are greater than the intensities or brightnesses on a straight line linking the intensity or brightness one lower than the maximum intensity or brightness and the minimum intensity or brightness, when the intensities or brightnesses as a function of the tones are plotted on a graph having the tones along the graph abscissa and the intensities or brightnesses on a logarithmic scale along the graph ordinate.

31. A display device which performs multiple-tone representations, said display device comprising:

a voltage generator which generates a plurality of drive voltages corresponding to a respective plurality of tones;

a data driver which receives display data, selects a drive voltage of a level corresponding to the received display data from among the plurality of drive voltages, and outputs the selected drive voltage of a level corresponding to the received display data:

a scan driver which outputs a selecting voltage; and a display panel having a plurality of pixels arranged in a matrix, said display panel coupled to said data driver and said scan driver and providing the drive voltage outputted from said data driver to a pixel selected from among the plurality of pixels in accordance with the selecting voltage outputted from said scan driver, wherein the plurality of tones is equal to or more than eight tones and wherein said voltage generator generates said plurality of drive voltages such that the intensity or brightness of each intermediate tone between the first tone of maximum drive voltage and the third tone which is one higher than the second tone of minimum drive voltage is above a straight line linking the intensity or brightness of said first tone and the intensity or brightness of said third tone on a graph on which intensities or brightnesses are plotted as a function of the plurality of tones, the graph abscissa representing tones and the graph ordinate representing intensity or brightnesses on a logarithmic scale.

32. A display device which performs multiple-tone representations, said display device comprising:

a voltage generator which generates a plurality of drive voltages corresponding to a respective plurality of tones;

a data driver which receives display data, selects a drive voltage of a level corresponding to the received display data from among the plurality of drive voltages, and outputs the selected drive voltage of a level corresponding to the received display data;

a scan driver which outputs a selecting voltage; and a display panel having a plurality of pixels arranged in a matrix, said display panel coupled to said data driver and said scan driver and providing the drive voltage outputted from said data driver to a pixel selected from among the plurality of pixels in accordance with the selecting voltage outputted from said scan driver, wherein the plurality of tones is equal to or more than eight tones, and wherein said voltage generator generates said plurality of drive voltages such that the intensity or brightness of each intermediate tone between the third tone which is one lower than the first tone of maximum drive voltage and the second tone of minimum drive voltage is above a straight line linking the intensity or brightness of said third tone and the intensity or brightness of said second tone on a graph on which intensities or brightnesses are plotted as a function of the plurality of tones, the graph abscissa representing tones and the graph ordinate representing intensities or brightnesses on a logarithmic scale.

33. A display device for providing multiple-tone representations, said display device comprising:

a voltage generator which generates a plurality of drive voltages corresponding to a respective plurality of tones;

a data driver which receives display data, selects a drive voltage of a level corresponding to the received display data from among the plurality of drive voltages, and outputs the selected drive voltage of a level corresponding to the received display data;

a scan driver which outputs a selecting voltage; and a display panel having a plurality of pixels arranged in a matrix, said display panel coupled to said data driver and said scan driver and providing the drive voltage outputted from said data driver to a pixel selected from among the plurality of pixels in accordance with the selecting voltage outputted from said scan driver, wherein when said display data is N bit data, the number of tones is $2^N$ wherein N is equal to or more than three, and wherein said voltage generator generates said plurality of drive voltages such that the intensity or brightness of each intermediate tone between the first tone of maximum drive voltage and the third tone which is (N−2) higher than the second tone of minimum drive voltage is above a straight line linking the intensity or brightness of said first tone and the intensity or brightness of said third tone on a graph on which intensities or brightnesses are plotted as a function of the plurality of tones, the graph abscissa representing tones and graph ordinate representing intensities or brightnesses on a logarithmic scale.

34. A display device for providing multiple-tone representations, said display device comprising:

a voltage generator which generates a plurality of drive voltages corresponding to a respective plurality of tones;

a data driver which receives display data, selects a drive voltage of a level corresponding to the received display data from among the plurality of drive voltages, and outputs the selected drive voltage of a level corresponding to the received display data;

a scan driver which outputs a selecting voltage; and a display panel having a plurality of pixels arranged in a matrix, said display panel coupled to said data driver and said scan driver and providing the drive voltage outputted from said data driver to a pixel selected from among the plurality of pixels in accordance with the selecting voltage outputted from said scan driver, wherein when said display data is N bit data, the number of tones is $2^N$, wherein N is equal to or more than three, and wherein said voltage generator generates said plurality of drive voltages such that the intensity or brightness of each intermediate tone between the third tone which is (N−2) the first tone of maximum drive voltage and the second tone of minimum drive voltage is above a straight line linking the intensity or brightness of said third tone and the intensity or brightness of said second tone on a graph on which intensities or brightnesses are plotted as a function of the plurality of tones, the graph abscissa representing tones and the graph ordinate representing intensities or brightnesses on a logarithmic scale.

35. A display device for providing multiple-tone representations, said display device comprising:

a voltage generator which generates a plurality of drive voltages corresponding to a respective plurality of tones;

a data driver which receives display data, selects a drive voltage of a level corresponding to the received display data from among the plurality of drive voltages, and outputs the selected drive voltage of a level corresponding to the received display data;

a scan driver which outputs a selecting voltage; and a display panel having a plurality of pixels arranged in a matrix, said display panel coupled to said data driver arid said scan driver and providing the drive voltage outputted from said data driver to a pixel selected from among the plurality of pixels in accordance with the selecting voltage outputted from said scan driver, wherein, when said display data is N bit data, the number of tones is $2^N$, wherein N is equal to or more than three, wherein said voltage generator generates said plurality of drive voltages such that the intensity or brightness of each intermediate tone between the first tone of maximum drive voltage and the third tone which is (N−2) higher than the second tone of minimum drive voltage is above a straight line linking the intensity or brightness of said first tone and the intensity or brightness of said third tone on a graph on which intensities or brightnesses are plotted as a function of the plurality of tones, the graph abscissa representing tones and the graph ordinate representing intensity or brightness on a logarithmic scale, and wherein differences between two drive voltages of adjacent two tones are non-uniform.

36. A display device as claimed in claim 34, wherein said difference of intermediate tones is less than said difference of high tones and said difference of low tones.

37. A display device for providing multiple tone representations, said display device comprising:

a voltage generator which generates a plurality of drive voltages corresponding to a respective plurality of tones;

a data driver which receives display data, selects a drive voltage of a level corresponding to the received display data from among the plurality of drive voltages, and outputs the selected drive voltage of a level corresponding to the received display data;

a scan driver which outputs a selecting voltage; and a display panel having a plurality of pixels arranged in a matrix, said display panel coupled to said data driver and said scan driver and providing the drive voltage outputted from said data driver to a pixel selected from among the plurality of pixels in accordance with the selecting voltage outputted from said scan driver, wherein, when said display data is N bit data, the number of tones is $2^N$ ;

wherein N is equal to or more than three, wherein said voltage generator generates said plurality of drive voltages such that the intensity or brightness of each intermediate tone between the third tone which is (N−2) lower than the first one of maximum drive voltage and the second tone of minimum drive voltage is above a straight line linking the intensity or brightness of said third tone maximum and the intensity or brightness of said second tone on a graph on which intensities or brightnesses are plotted as a function of the plurality of tones, the graph abscissa representing tones and the graph ordinate representing intensity or brightness on a logarithmic scale, and wherein difference between two drive voltages of adjacent two tones are non-uniform.

* * * * *

UNITED STATES PATENT AND TRADEMARK OFFICE

CERTIFICATE OF CORRECTION

PATENT NO. : 6,888,525 B2
APPLICATION NO. : 10/425834
DATED : May 3, 2005
INVENTOR(S) : Naruhiko Kasai et al.

It is certified that error appears in the above-identified patent and that said Letters Patent is hereby corrected as shown below:

IN THE CLAIMS:

Please amend the independent claims 1, 12-15 and 27-35 and 37 as follows:

-- 1. (currently amended) A display device; for providing multiple-tone representations, the display device comprising:

a data driver for receiving display data and providing a drive voltage of a level corresponding to the display data;

a scan driver for providing a selecting voltage; and a display panel having a plurality of pixels arranged in a matrix, wherein the display panel is coupled to the data driver and to the scan driver to provide the drive voltage from the data driver to a pixel of the display panel selected in accordance with the selecting voltage, wherein selected pixel of the display panel displays a tone corresponding to the drive voltage, wherein the number of tones is equal to or more than eight, and wherein the intensities or brightnesses of all the intermediate tones between the first tone corresponding to the maximum drive voltage and the third tone one higher than the second tone corresponding to the minimum drive voltage are at least as great as the intensities or brightnesses on a straight line linking the intensity or brightness of the first tone and the intensity or brightness of the third tone, when the intensities or It is certified that error appears in the above-identified patent and that said Letters Patent is hereby corrected as shown below:

brightnesses as a function of the tones are plotted on a graph having the tones along the graph abscissa and the intensity or brightness on a logarithmic scale along the graph ordinate.

12. (currently amended) A display device for providing multiple-tone representations, the display device comprising:

a data driver for receiving display data, and providing a drive voltage of a level corresponding to the display data;

a scan driver for providing a selecting voltage; and a display panel having a plurality of pixels arranged in a matrix, <u>wherein</u> the display panel <u>is</u> coupled to the data driver and to the scan driver to provide the drive voltage from the data driver to a pixel of the display panel selected in accordance with the selecting voltage, wherein the selected pixel of the display panel displays a tone corresponding to the drive voltage, wherein the number of tones is equal to or more than eight, and wherein intensities or brightnesses of all the intermediate tones between the maximum intensity or brightness and the intensity or brightness one higher than the minimum intensity or brightness which the display panel is capable of showing are greater than the intensities or brightnesses on a straight line linking the maximum It is certified that error appears in the above-identified patent and that said Letters Patent is hereby corrected as shown below:

intensity or brightness and the intensity or brightness one higher than the minimum intensity or brightness, when the intensities or brightnesses as a function of the tones are plotted on a graph having the tones along the graph abscissa and the intensities or brightnesses on a logarithmic scale along the graph ordinate.

13. (currently amended) A display device for providing multiple-tone representations, the display device comprising:

a data driver for receiving display data and providing drive voltages of a level corresponding to the display data;

a scan driver for providing a selecting voltage, and a display panel having a plurality of pixels arranged in a matrix, <u>wherein</u> the display panel <u>is</u> coupled to the data driver and to the scan driver to provide the drive voltages to a line of pixels of the display panel selected in accordance with the selecting voltage, wherein the selected line of pixels of the display panel displays tones corresponding to the drive voltages, wherein the number of tones is equal to or more than eight, and wherein intensities or brightnesses of all the intermediate tones between the first tone corresponding to the maximum drive voltage and the third tone one higher than the second tone corresponding to the minimum drive voltage form a line above a straight It is certified that error appears in the above-identified patent and that said Letters Patent is hereby corrected as shown below:

line linking the intensity or brightness of the first tone and the intensity or brightness of the third tone on a graph having the tones along the graph abscissa and the intensities or brightnesses on a logarithmic scale along the graph ordinate.

14. (currently amended) A display device for providing multiple-tone representations, the display device comprising:

a data driver for receiving display data, and providing a drive voltage of a level corresponding to the display data;

a scan driver for providing a selecting voltage; and a display panel having a plurality of pixels arranged in a matrix, <u>wherein</u> the display panel <u>is</u> coupled to the data driver and to the scan driver to provide the drive voltage to a pixel of the display panel selected in accordance with the selecting voltage, wherein the selected pixel of the display panel displays a tone corresponding to the drive voltage, wherein the number of tones is equal to more than eight, and wherein all the intensities or brightnesses between the maximum intensity or brightness and the intensity or brightness one higher than the minimum intensity or brightness which the display panel is capable of showing are greater than the intensities or brightnesses on a straight line linking the maximum intensity or brightness and the intensity or brightness one higher than the minimum intensity or brightness, when the It is certified that error appears in the above-identified patent and that said Letters Patent is hereby corrected as shown below:

intensities or brightnesses as a function of the tones are plotted on a graph having the tones along the graph abscissa and the intensities or brightnesses on a logarithmic scale along the graph ordinate.

15. (currently amended) A display device for providing multiple-tone representations, the display device comprising:

a data driver for receiving display data and providing a drive voltage of a level corresponding to the display data;

a scan driver for providing a selecting voltage; and a display panel having a plurality of pixels arranged in a matrix, <u>wherein</u> the display panel <u>is</u> coupled to the data driver and to the scan driver to provide the drive voltage from the data drive to a pixel of the display panel selected in accordance with the selecting voltage, wherein the selected pixel of the display panel displays a tone corresponding to the drive voltage, wherein the number of tones is equal to or more than eight, and wherein the intensities or brightnesses of all the intermediate tones between the third tone one lower than the first tone corresponding to the maximum drive voltage and the second tone corresponding to the minimum drive voltage are at least as great as the intensities or brightnesses on a straight line linking the intensity or brightness of the It is certified that error appears in the above-identified patent and that said Letters Patent is hereby corrected as shown below:

third tone and the intensity or brightness of the second tone, when the intensities or brightness as a function of the tones are plotted on a graph having the tones along the graph abscissa and the intensity or brightness on a logarithmic scale along the graph ordinate.

27. (currently amended) A display device for providing a multiple-tone representations, the display device comprising:

a data driver for receiving display data, and providing a drive voltage of a level corresponding to the display data;

a scan driver for providing a selecting voltage; and a display panel having a plurality of pixels arranged in a matrix, <u>wherein</u> the display panel <u>is</u> coupled to the data driver and to the scan driver to provide the drive voltage from the data driver to a pixel of the display panel selected in accordance with the selecting voltage, wherein the selected pixel of the display panel displays a tone corresponding to the drive voltage, wherein the number of tones is equal to or more than eight, and wherein the intensities or brightnesses of all the intermediate tones between the intensity or brighteness one lower than the maximum intensity or brightness and the minimum intensity or brightness which the display panel is capable of showing are It is certified that error appears in the above-identified patent and that said Letters Patent is hereby corrected as shown below:

greater than the intensities or brightnesses on a straight line linking the intensity or brightness one lower than the maximum intensity or brightness and the minimum intensity or brightness, when the intensities or brightnesses as a function of the tones are plotted on a graph having the tones along the graph abscissa and the intensities or brightnesses on a logarithmic scale along the graph ordinate.

28. (currently amended) A display device for providing multiple-tone representations, the display device comprising:

a data driver for receiving display data and providing drive voltages of a level corresponding with the display data;

a scan driver for providing a selecting voltage; and a display panel having a plurality of pixels arranged in a matrix, <u>wherein</u> the display panel <u>is</u> coupled to the data driver and to the scan driver to provide the drive voltages to a line of pixels of the display panel selected in accordance with the selecting voltage, wherein the selected line of pixels of the display panel displays tones corresponding to the drive voltages, wherein the number of tones is equal to or more than eight, and wherein the intensities or brightnesses of all the intermediate tones between the third tone one lower than the first tone corresponding to the maximum drive voltage and the It is certified that error appears in the above-identified patent and that said Letters Patent is hereby corrected as shown below:

second tone corresponding to the minimum drive voltage form a line above a straight line linking the intensity or brightness of the third tone and the intensity or brightness of the second tone on a graph having the tones along the graph abscissa and the intensities or brightnesses on a logarithmic scale along the graph ordinate.

29. (currently amended) A display device for providing multiple-tone representations, the display device comprising:

a data driver for receiving display data, and providing a drive voltage of a level corresponding to the display data;

a scan driver for providing a selecting voltages; and a display panel having a plurality of pixels arranged in a matrix, <u>wherein</u> the display panel <u>is</u> coupled to the data driver and to the scan driver to provide the drive voltage to a pixel of the display panel selected in accordance with the selecting voltage, wherein the selected pixel of the display panel displays a tone corresponding to the drive voltage, wherein the number of tones is equal to or more than eight, and wherein all the intensities or brightnesses between the intensity or brightness one lower than the maximum intensity or brightness and the minimum intensity or brightness which the display panel is capable of showing are greater than the intensities or brightnesses on a straight line linking the intensity or brightness one lower than the It is certified that error appears in the above-identified patent and that said Letters Patent is hereby corrected as shown below:

maximum intensity or brightness and the minimum intensity or brightness, when the intensities or brightnesses as a function of the tones are plotted on a graph having the tones along the graph abscissa and the intensities or brightnesses on a logarithmic scale along the graph ordinate.

30. (currently amended) A display device for providing multiple-tone representations, the display device comprising:

a data driver for receiving display data, and providing a drive voltage of a level corresponding to the display data;

a scan driver for providing a selecting voltage; and a display panel having a plurality of pixels arranged in a matrix, <u>wherein</u> the display panel <u>is</u> coupled to the data driver and to the scan driver to provide the drive voltage to a pixel of the display panel selected in accordance with the selecting voltage, wherein the selected pixel of the display panel displays a tone corresponding to the drive voltage, wherein the number of tones is equal to or more than eight, and wherein all the intensities or brightnesses between the intensity or brightness one lower than the maximum intensity or brightness and the minimum intensity or brightness which the display panel is capable of showing are greater than the intensities or brightnesses on a straight line linking the intensity or brightness one lower than the It is certified that error appears in the above-identified patent and that said Letters Patent is hereby corrected as shown below:

maximum intensity or brightness and the minimum intensity or brightness, when the intensities or brightnesses as a function of the tones are plotted on a graph having the tones along the graph abscissa and the intensities or brightnesses on a logarithmic scale along the graph ordinate.

31. (currently amended) A display device which performs multiple-tone representations, said display device comprising:

a voltage generator which generates a plurality of drive voltages corresponding to a respective plurality of tones;

a data driver which receives display data, selects a drive voltage of a level corresponding to the received display data from among the plurality of drive voltages, and outputs the selected drive voltage of a level corresponding to the received display data;

a scan driver which outputs a selecting voltage; and a display panel having a plurality of pixels arranged in a matrix, <u>wherein</u> said display panel <u>is</u> coupled to said data driver and said scan driver and providing the drive voltage outputted from said data driver to a pixel selected from among the plurality of pixels in accordance with the selecting voltage outputted from said scan driver, wherein the plurality of tones is equal to or more than eight tones, and wherein said voltage generator generates said plurality of drive voltages such that the intensity or It is certified that error appears in the above-identified patent and that said Letters Patent is hereby corrected as shown below:

brightness of each intermediate tone between the first tone of maximum drive voltage and the third tone which is one higher than the second tone of minimum drive voltage is above a straight line linking the intensity or brightness of said first tone and the intensity or brightness of said third tone on a graph on which intensities or brightnesses are plotted as a function of the plurality of tones, the graph abscissa representing tones and the graph ordinate representing intensity or brightnesses on a logarithmic scale.

32. (currently amended) A display device which performs multiple-tone representations, said display device comprising:

a voltage generator which generates a plurality of drive voltages corresponding to a respective plurality of tones;

a data driver which receives display data, selects a drive voltage of a level corrsponding to the received display data from among the plurality of drive voltages, and outputs the selected drive voltage of a level corresponding to the received display data;

a scan driver which outputs a selecting voltage; and a display panel having a plurality of pixels arranged in a matrix, <u>wherein</u> said display panel <u>is</u> coupled to said data driver and said scan driver and providing the drive voltage outputted from said data driver to a pixel selected from among the plurality of pixels in accordance with the selecting voltage outputted from said scan driver, It is certified that error appears in the above-identified patent and that said Letters Patent is hereby corrected as shown below:

wherein the plurality of tones is equal to or more than eight tones, and wherein said voltage generator generates said plurality of drive voltages such that the intensity or brightness of each intermediate tone between the third tone which is one lower than the first tone of maximum drive voltage and the second tone of minimum drive voltage is above a straight line linking the intensity or brightness of said third tone and the intensity or brightness of said second tone on a graph on which intensities or brightnesses are plotted as a function of the plurality of tones, the graph abscissa representing tones and the graph ordinate representing intensities or brightnesses on a logarithmic scale.

33. (currently amended) A display device for providing multiple-tone representations, said display device comprising:

a voltage generator which generates a plurality of drive voltages corresponding to a respective plurality of tones;

a data driver which receives display data, selects a drive voltage of a level corresponding to the received display data from among the plurality of drive voltages, and outputs the selected drive voltage of a level corresponding to the received display data;

a scan driver which outputs a selecting voltage; and a display panel having a plurality of pixels arranged in a matrix, <u>wherein</u> said It is certified that error appears in the above-identified patent and that said Letters Patent is hereby corrected as shown below:

display panel is coupled to said data driver and said scan driver and providing the drive voltage outputted from said data driver to a pixel selected from among the plurality of pixels in accordance with the selecting voltage outputted from said scan driver, wherein, when said display data is N bit data, the number of tones is $2^N$, wherein N is equal to or more than three, and wherein said voltage generator generates said plurality of drive voltages such that the intensity or brightness of each intermediate tone between the first tone of maximum drive voltage and the third tone which is (N - 2) higher than the second tone of minimum drive voltage is above a straight line linking the intensity or brightness of said first tone and the intensity or brightness of said third tone on a graph on which intensities or brightnesses are plotted as a function of the plurality of tones, the graph abscissa representing tones and graph ordinate representing intensities or brightnesses on a logarithmic scale.

34. (currently amended) A display device for providing multiple-tone representations, said display device comprising:

a voltage generator which generates a plurality of drive voltages corresponding to a respective plurality of tones;

a data driver which receives display data, selects a drive voltage of a level corresponding to the received display data from among the plurality of drive It is certified that error appears in the above-identified patent and that said Letters Patent is hereby corrected as shown below:

voltages, and outputs the selected drive voltage of a level corresponding to the received display data;

a scan driver which outputs a selecting voltage; and a display panel having a plurality of pixels arranged in a matrix, wherein said display panel is coupled to said data driver and said scan driver and providing the drive voltage outputted from said data driver to a pixel selected from among the plurality of pixels in accordance with the selecting voltage outputted from said scan driver, wherein, when said display data is N bit data, the number of tones is $2^N$, wherein N is equal to or more than three, and wherein said voltage generator generates said plurality of drive voltages such that the intensity or brightness of each intermediate tone between the third tone which is (N - 2) the first tone of maximum drive voltage and the second tone of minimum drive voltage is above a straight line linking the intensity or brightness of said third tone whose and the intensity or brightness of said second tone on a graph on which intensities or brightnesses are plotted as a function of the plurality of tones, the graph abscissa representing tones and the graph ordinate representing intensities or brightnesses on a logarithmic scale.

35. (currently amended) A display device for providing multiple-tone representations, said display device comprising:

It is certified that error appears in the above-identified patent and that said Letters Patent is hereby corrected as shown below:

a voltage generator which generates a plurality of drive voltages corresponding to a respective plurality of tones;

a data driver which receives display data, selects a drive voltage of a level corresponding to the received display data from among the plurality of drive voltages, and outputs the selected drive voltage of a level corresponding to the received display data;

a scan driver which outputs a selecting voltage; and a display panel having a plurality of pixels arranged in a matrix, wherein said display panel is coupled to said data driver arid said scan driver and providing the drive voltage outputted from said data driver to a pixel selected from among the plurality of pixels in accordance with the selecting voltage outputted from said scan driver, wherein, when said display data is N bit data, the number of tones is $2^N$, wherein N is equal to or more than three, wherein said voltage generator generates said plurality of drive voltages such that the intensity or brightness of each intermediate tone between the first tone of maximum drive voltage and the third tone which is (N - 2) higher than the second tone of minimum drive voltage is above a straight line linking the intensity or brightness of said first tone and the intensity or brightness of said third tone on a graph on which intensities or brightnesses are plotted as a function of the plurality of tones, the graph abscissa representing tones and the graph ordinate representing intensity or brightness It is certified that error appears in the above-identified patent and that said Letters Patent is hereby corrected as shown below:

on a logarithmic scale, and wherein differences between two drive voltages of adjacent two tones are non-uniform.

37. (currently amended) A display device for providing multiple tone representations, said display device comprising:

a voltage generator which generates a plurality of drive voltages corresponding to a respective plurality of tones;

a data driver which receives display data, selects a drive voltage of a level corresponding to the received display data from among the plurality of drive voltages, and outputs the selected drive voltage of a level corresponding to the received display data;

a scan driver which outputs a selecting voltage; and a display panel having a plurality of pixels arranged in a matrix, <u>wherein</u> said display panel <u>is</u> coupled to said data driver and said scan driver and providing the drive voltage outputted from said data driver to a pixel selected from among the plurality of pixels in accordance with the selecting voltage outputted from said scan driver, wherein, when said display data is N bit data, the number of tones is $2^N$, wherein N is equal to or more than three, wherein said voltage generator generates said plurality of drive voltages such that

UNITED STATES PATENT AND TRADEMARK OFFICE

CERTIFICATE OF CORRECTION

PATENT NO. : 6,888,525 B2
APPLICATION NO. : 10/425834
DATED : May 3, 2005
INVENTOR(S) : Naruhiko Kasai et al.

It is certified that error appears in the above-identified patent and that said Letters Patent is hereby corrected as shown below:

the intensity or brightness of each intermediate tone between the third tone which is (N - 2) lower than the first one of maximum drive voltage and the second tone of minimum drive voltage is above a straight line linking the intensity or brightness of said third tone maximum and the intensity or brightness of said second tone on a graph on which intensities or brightnesses are plotted as a function of the plurality of tones, the graph abscissa representing tones and the graph ordinate representing intensity or brightness on a logarithmic scale, and wherein difference between two drive voltages of adjacent two tones are non-uniform.

Signed and Sealed this

Nineteenth Day of September, 2006

JON W. DUDAS
*Director of the United States Patent and Trademark Office*